US011738937B2

(12) United States Patent
Cavalcante et al.

(10) Patent No.: US 11,738,937 B2
(45) Date of Patent: Aug. 29, 2023

(54) CRATE WITH RETRACTABLE WALL

(71) Applicant: Rehrig Pacific Company, Los Angeles, CA (US)

(72) Inventors: Mauricio D. Cavalcante, Spring, TX (US); John Bobel Zelek, Los Angeles, CA (US); William P. Apps, Alpharetta, GA (US); Ryan C. Meers, West Chester, PA (US)

(73) Assignee: Rehrig Pacific Company, Los Angeles, CA (US)

( * ) Notice: Subject to any disclaimer, the term of this patent is extended or adjusted under 35 U.S.C. 154(b) by 29 days.

(21) Appl. No.: 17/206,682

(22) Filed: Mar. 19, 2021

(65) Prior Publication Data

US 2021/0206564 A1 Jul. 8, 2021

Related U.S. Application Data

(60) Continuation of application No. 16/101,632, filed on Aug. 13, 2018, now Pat. No. 10,988,308, which is a division of application No. 15/332,400, filed on Oct. 24, 2016, now Pat. No. 10,077,152, which is a division of application No. 14/515,027, filed on Oct. 15, 2014, now Pat. No. 9,475,638, which is a division of application No. 13/537,210, filed on Jun. 29, 2012, now Pat. No. 8,863,971.

(60) Provisional application No. 61/550,892, filed on Oct. 24, 2011, provisional application No. 61/530,389, filed on Sep. 1, 2011, provisional application No. 61/507,917, filed on Jul. 14, 2011, provisional application No. 61/502,847, filed on Jun. 29, 2011.

(51) Int. Cl.

| | |
|---|---|
| ***B65D 88/52*** | (2006.01) |
| ***B65D 25/00*** | (2006.01) |
| ***B65D 6/18*** | (2006.01) |
| ***B65D 88/10*** | (2006.01) |
| ***B65D 25/30*** | (2006.01) |
| ***B65D 85/32*** | (2006.01) |

(52) U.S. Cl.

CPC ..... *B65D 88/52* (2013.01); *B65D 11/1833* (2013.01); *B65D 25/005* (2013.01); *B65D 25/30* (2013.01); *B65D 85/32* (2013.01); *B65D 88/10* (2013.01); *B65D 11/184* (2013.01); *B65D 88/522* (2013.01); *B65D 88/524* (2013.01)

(58) Field of Classification Search

CPC ..... B65D 6/18; B65D 88/52; B65D 88/522; B65D 11/184; B65D 55/524; B65D 7/26; B65D 7/18; B65D 7/24; B65D 11/1833; B65D 9/14; B62B 3/10

USPC ..... 220/4.29, 666, 7, 6, 4.28

See application file for complete search history.

(56) References Cited

U.S. PATENT DOCUMENTS 578,445 A * 3/1897 Cobleigh ..... B65D 9/14 217/14

698,226 A * 4/1902 Roberts ..... A63B 47/02 294/99.1

(Continued)

*Primary Examiner* — Ernesto A Grano

(74) *Attorney, Agent, or Firm* — Carlson, Gaskey & Olds, P.C.

(57) ABSTRACT

A crate includes a base and a plurality of walls including a front wall. The front wall is movable between a retracted, open position and a closed position. In some embodiments, the front wall includes a frame, a first portion and a second portion. The first portion is hingeably connected to the frame and the second portion is hingeably connected to the first portion.

21 Claims, 22 Drawing Sheets

(56) References Cited

U.S. PATENT DOCUMENTS 1,268,715 A * 6/1918 Hoffman ..... B65D 9/14 217/14
1,822,772 A * 9/1931 Fell ..... A01K 31/07 119/453
2,024,075 A * 12/1935 Swaim ..... B65D 5/448 217/12 A
3,315,835 A * 4/1967 Katzman ..... B65D 21/0211 220/6
3,410,328 A * 11/1968 Sasai ..... B65D 7/26 5/98.1
3,812,999 A * 5/1974 Joseph ..... B65D 19/10 312/297
3,841,519 A * 10/1974 Stromberg ..... B65D 1/243 206/427
3,958,713 A * 5/1976 Selz ..... B65D 19/12 220/493
4,023,698 A * 5/1977 Joseph ..... B65D 19/12 217/15
4,040,461 A * 8/1977 Carson ..... B65D 25/14 220/9.1
4,120,417 A * 10/1978 Aquino ..... B65D 7/18 220/9.4
4,561,547 A * 12/1985 Estwanik, III ..... A47B 81/00 211/113
4,720,020 A * 1/1988 Su ..... B65D 11/1826 220/6
4,914,874 A * 4/1990 Graham, Jr. ..... E04B 1/6116 217/43 A
5,161,709 A * 11/1992 Oestreich, Jr. ..... B65D 25/005 220/4.28
5,484,091 A * 1/1996 Malinowski ..... B60R 7/02 224/42.33
6,044,998 A * 4/2000 Schearer ..... B65D 19/18 206/600
6,123,344 A * 9/2000 Clegg ..... B62B 1/14 280/47.26
6,216,899 B1 * 4/2001 Vicari ..... B65D 19/16 206/600
6,601,724 B1 * 8/2003 Koefelda ..... B65D 11/1833 220/4.28
6,902,061 B1 * 6/2005 Elstone ..... B65D 19/02 206/596
7,264,122 B2 * 9/2007 Koefelda ..... B65D 11/1833 220/4.28
7,290,663 B2 * 11/2007 Deng ..... B65D 11/1826 206/600
7,377,565 B1 * 5/2008 Beavin ..... A63B 47/02 294/19.2
7,416,092 B2 * 8/2008 Dubois ..... B65D 19/18 220/6
7,806,259 B2 * 10/2010 Gregory ..... A63B 71/0045 206/315.9
7,861,458 B2 * 1/2011 Apps ..... B65D 11/1833 220/254.1
7,896,184 B2 * 3/2011 Meers ..... B65D 25/005 220/666
8,066,147 B2 * 11/2011 Meers ..... B65D 11/184 220/666
8,297,669 B2 * 10/2012 Matthews ..... A63B 47/002 294/19.2
8,561,836 B2 * 10/2013 Cook ..... B65D 25/005 220/601
8,646,639 B2 * 2/2014 Pils ..... B65D 25/005 220/666
8,820,558 B2 * 9/2014 Van der Korput ..... B65D 19/08 220/660
8,863,971 B2 * 10/2014 Cavalcante ..... B65D 25/005 220/601
9,278,775 B2 * 3/2016 Meers ..... B65D 21/0212
9,475,638 B2 * 10/2016 Cavalcante ..... B65D 88/52
10,183,209 B1 * 1/2019 Orenstein ..... B62B 3/005
10,472,129 B2 * 11/2019 Meers ..... B65D 21/0212
10,689,155 B2 * 6/2020 Sullivan ..... B65D 9/12
2003/0164374 A1 * 9/2003 Orset ..... B65D 19/18 220/7
2004/0200833 A1 * 10/2004 Dubois ..... B65D 19/18 220/6
2006/0186000 A1 * 8/2006 Gregory ..... A63B 71/0036 206/315.9
2006/0237455 A1 * 10/2006 Vargas ..... B65D 11/1873 220/4.34
2008/0142530 A1 * 6/2008 Meers ..... B65D 21/0233 220/666
2009/0057320 A1 * 3/2009 Meers ..... B65D 25/005 220/660
2009/0134157 A1 * 5/2009 Meers ..... B65D 25/005 220/6
2013/0001223 A1 * 1/2013 Cavalcante ..... B65D 88/52 220/660
2013/0081324 A1 * 4/2013 Diclaro, II ..... A01M 1/106 43/131
2014/0251992 A1 * 9/2014 Cavalcante ..... B65D 11/184 220/4.28
2016/0107803 A1 * 4/2016 Reinhart ..... B65D 43/0208 220/315
2016/0185487 A1 * 6/2016 Meers ..... B65D 21/0233 220/6

* cited by examiner

CRATE WITH RETRACTABLE WALL

BACKGROUND

The present invention relates generally to containers and more particularly to a crate that is particularly useful for transporting egg cartons or other items to a store.

Currently, egg cartons are shipped to stores in metal crates. The crates must be unloaded onto shelves for the customers to select and purchase. This requires labor for handling the egg cartons in the store. The metal crates are expensive and are damaged easily. They are also subject to rust and are not recyclable. They are also not easily repairable.

SUMMARY

A crate includes a base and a plurality of walls including a front wall. The front wall is movable between a retracted, open position and a closed position.

In some embodiments, the front wall includes a frame, a first portion and a second portion. The first portion is hingeably connected to the frame and the second portion is hingeably connected to the first portion.

The first portion and the second portion may each include a horizontal wall portion and a pair of arms. In some embodiments, the second portion may optionally be connected to the crate only via hinges at outer ends of the pair of arms of the second portion.

In some embodiments, the arms may extend upward from the horizontal portion of the second portion when the front wall is in the closed position and when the front wall is in the retracted, open position.

In some embodiments, the arms extend downward from the horizontal portion of the first portion when the front wall is in the closed position and the arms extend upward from the horizontal portion of the first portion when the front wall is in the retracted, open position.

The arms of the second portion may be hingeably connected to the arms of the first portion between the horizontal portion of the first portion and the hinged connection of the first portion to the frame.

In order to keep the goods in the crate when the front wall is in the closed position, the horizontal portion of the first portion can be spaced vertically above the horizontal portion of the second portion.

To facilitate the removal of the goods from the crate, when the front wall is in the open, retracted position, the horizontal portion of the first portion is at substantially the same height as the horizontal portion of the second portion adjacent the base.

In another embodiment, the front wall includes a third portion hingeably connected to the second portion and hingeably connected to the frame.

In another embodiment, the front wall is connected to a plurality of arms and the front wall is retractable to a retracted position adjacent an outer surface of the rear wall.

In another embodiment, the plurality of walls includes a pair of side walls adjacent the front wall. The front wall includes a pair of front wall portions that are selectively retractable into a position parallel to the side walls. Each of the side walls and each of the front wall portions may optionally include a handle opening, such that the handle openings of the front wall portions align with the handle openings of the side walls when the front wall portions are retracted.

In another embodiment, the front wall includes an upper rail and a plurality of cords extending from the upper rail to the base. The upper rail is movable from an upper position when the front wall is in the closed position, to a lower position when the front wall is in the open, retracted position.

In another embodiment, the front wall includes an upper rail and a plurality of braces (first and second portions) extending from the upper rail to the base. The braces are pivotably and slidably connected to the upper rail and to the base.

DESCRIPTION OF PREFERRED EMBODIMENTS

Figure 1:
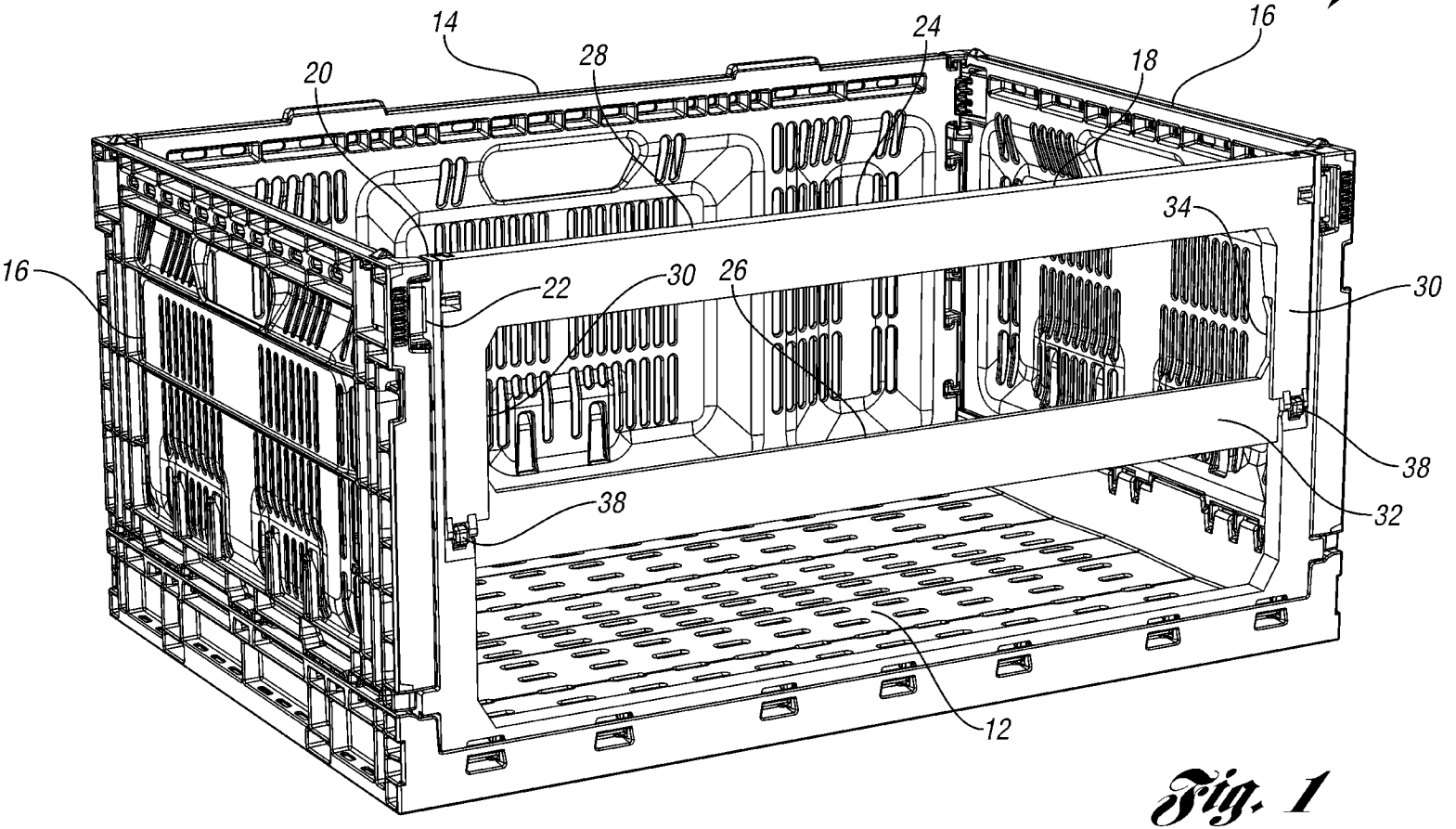
FIG. 1 is a perspective view of a crate according to a first embodiment.

A collapsible container 10 according to a first embodiment is shown in FIGS. 1-4. In FIG. 1, the container 10 is in an upright, assembled position. The container 10 includes a base 12. A rear wall 14, end walls 16 and a front wall 18 are pivotably connected at a periphery of the base 12. Known hinges and latches can be used with the walls 14, 16, 18 of the collapsible container 10.

The front wall 18 includes a frame 20 pivotably connected to the base 12 and selectively connected to the end walls 16 by latches 22. The front wall 18 further includes an upper (or "first") portion 24 and a lower (or "second") portion 26. The upper portion 24 includes a horizontal wall portion 28 and a pair of arms 30 extending from ends of the horizontal wall portion 28 in a direction generally perpendicular to the horizontal wall portion 28 to form generally a U-shape (opening downward in FIG. 1). In FIG. 1, the upper portion 24 is selectively latched to the frame 20 in an upper position by a latch. The arms 30 of the upper portion 24 are pivotably connected to the frame 20 by hinges 38 on the front of the frame 20. The lower portion 26 includes a horizontal wall portion 32 and a pair of arms 34 extending from ends of the horizontal wall portion 32 in a direction generally perpendicular to the horizontal wall portion 32 to form generally a U-shape (opening upward in FIG. 1).

In FIG. 1, the walls 14, 16, 18 are in their upright, use position. The front wall 18 is in its deployed, closed position, with the horizontal wall portion 28 of the upper portion 24 and the horizontal wall portion 32 of the lower portion 26 extending across an upper portion and a mid-portion, respectively, of a large opening defined by the frame 20. In the deployed, closed position, the front wall 18 keeps objects, such as egg cartons, in the container 10.

Figure 2:
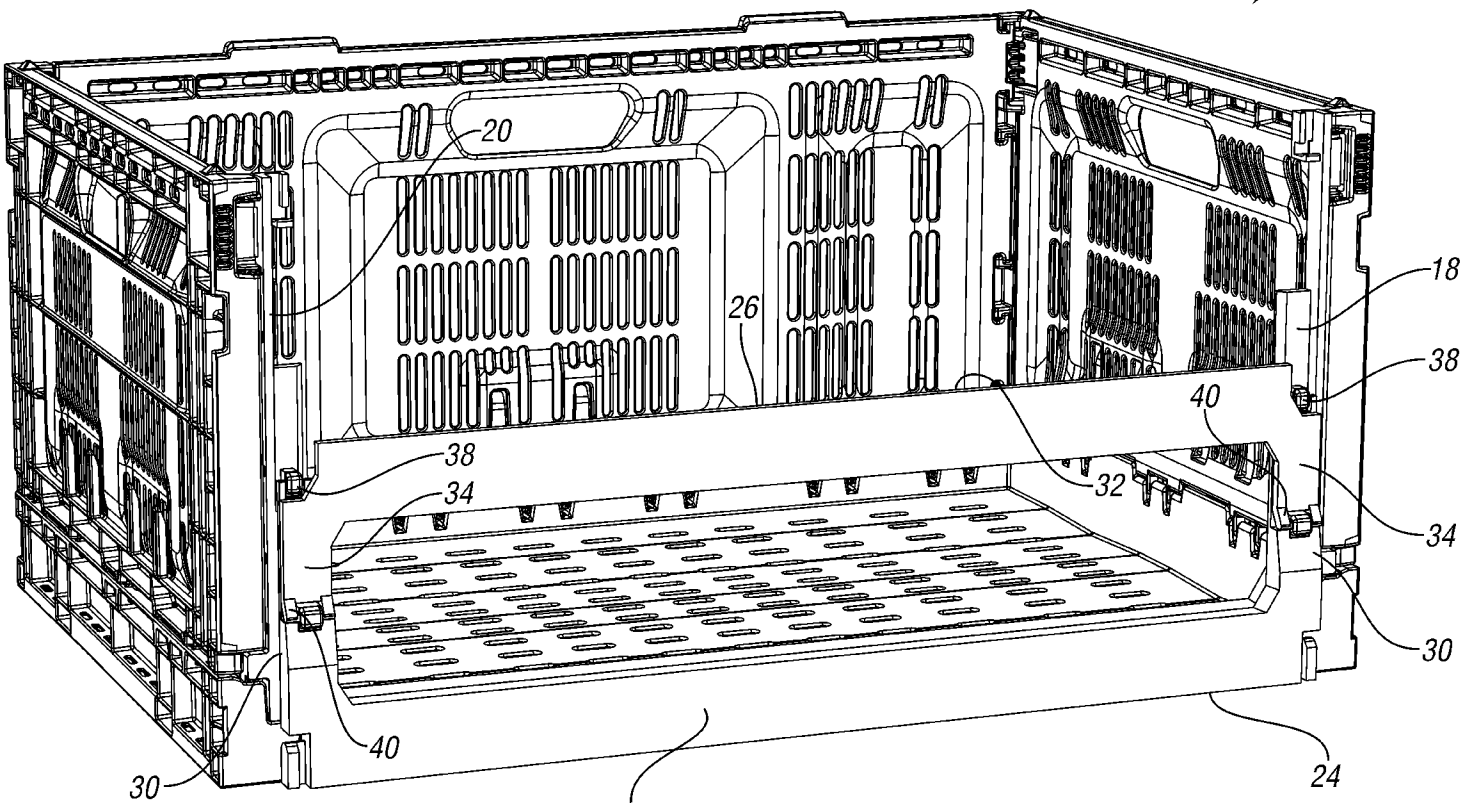
FIG. 2 shows the crate of FIG. 1 with the upper portion of the front wall pivoted downward.

In FIG. 2, the upper portion 24 has been pivoted downward about hinges 38, such that the arms 30 extend downward from the hinges 38 and the horizontal wall portion 28 extends across a bottom of the front wall 18. In FIG. 2, the lower portion 26 has also been flipped relative to FIG. 1, such that the arms 34 now extend upward from the hinges 40 on the rear surface of the arms 30 of the upper portion 24.

Figure 3:
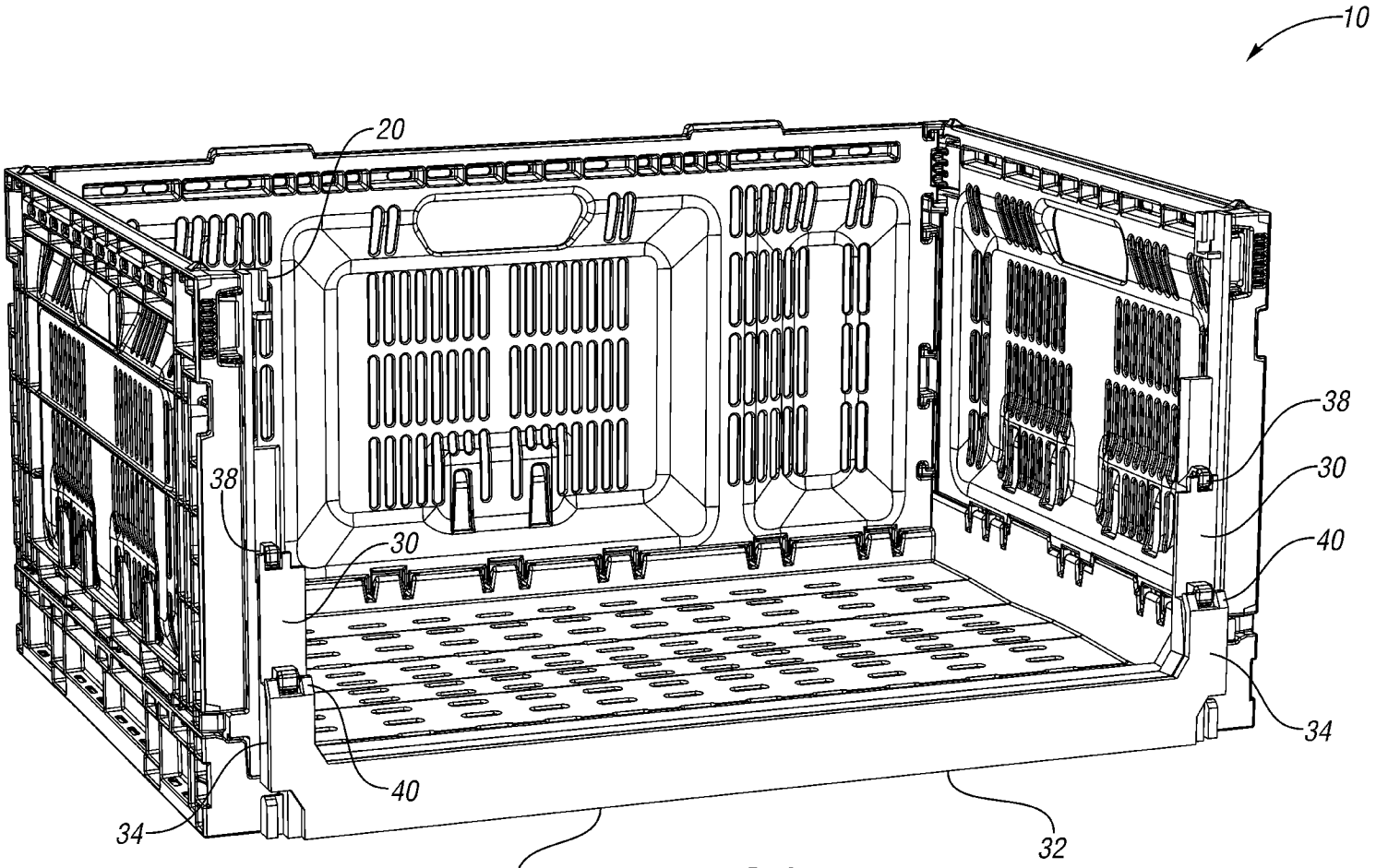
FIG. 3 shows the crate of FIG. 1 with the front wall in the retracted position with the upper portion and the lower portion of the front wall pivoted downward.

In FIG. 3, the lower portion 26 is pivoted about the hinges 38 on the arms 30 of the upper portion 24 to a lower position, across the bottom of the front wall 18, where the horizontal wall portion 32 of the lower portion 26 is substantially aligned with the horizontal wall portion 32 of the upper portion 24. In FIG. 3, the front wall 18 is in a retracted, open position, in which consumers can access the contents (such as egg cartons) of the container 10. Note that it is also possible to move the front wall 18 to the retracted, open position even when an identical container is stacked on the container 10.

Figure 4:
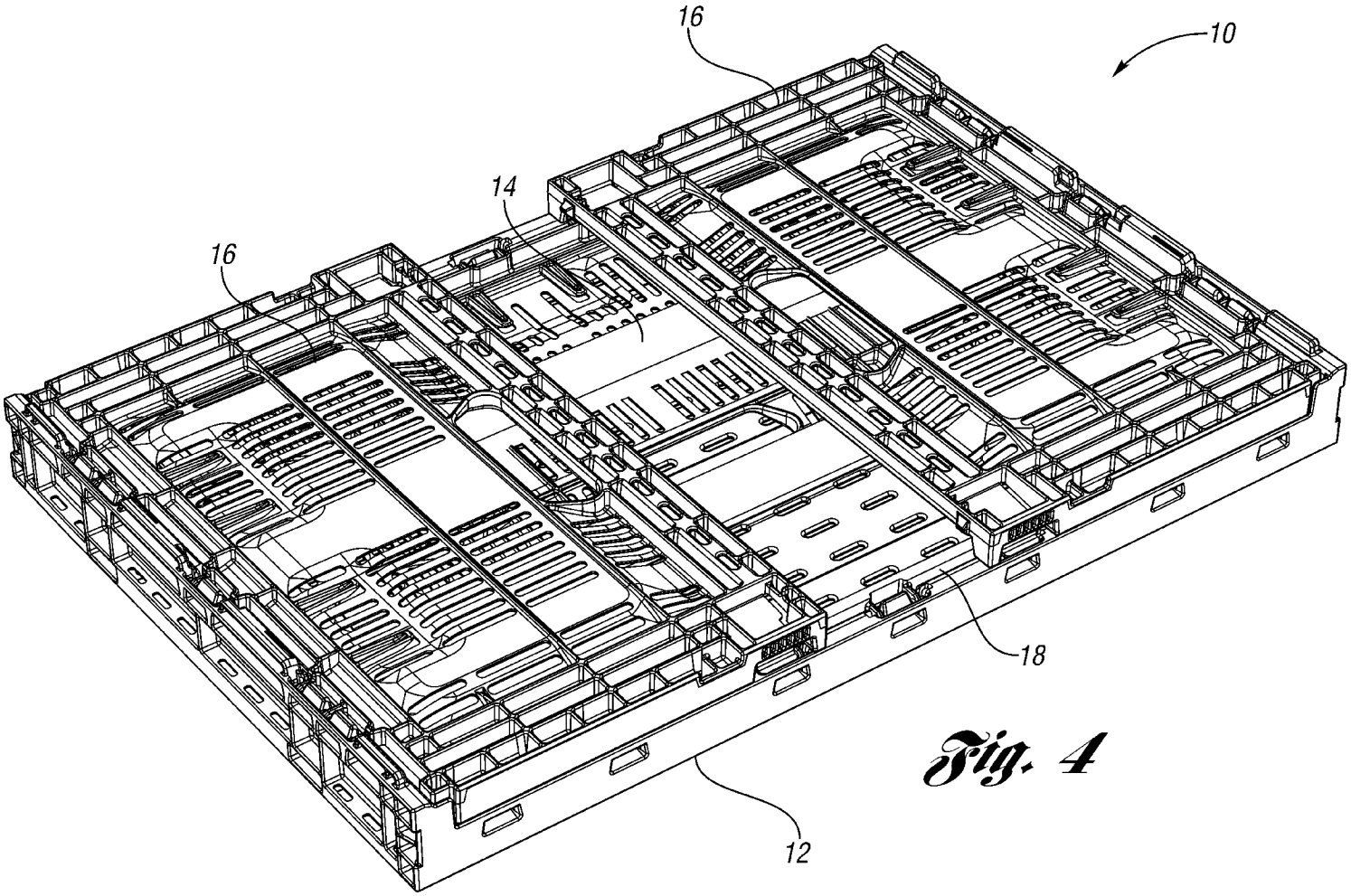
FIG. 4 shows the crate of FIG. 1 in the collapsed position.

When the container 10 is empty, the walls 14, 16, 18 can be collapsed onto the base 12 as shown in FIG. 4 for more efficient storage and shipping to be reused.

Figure 5:
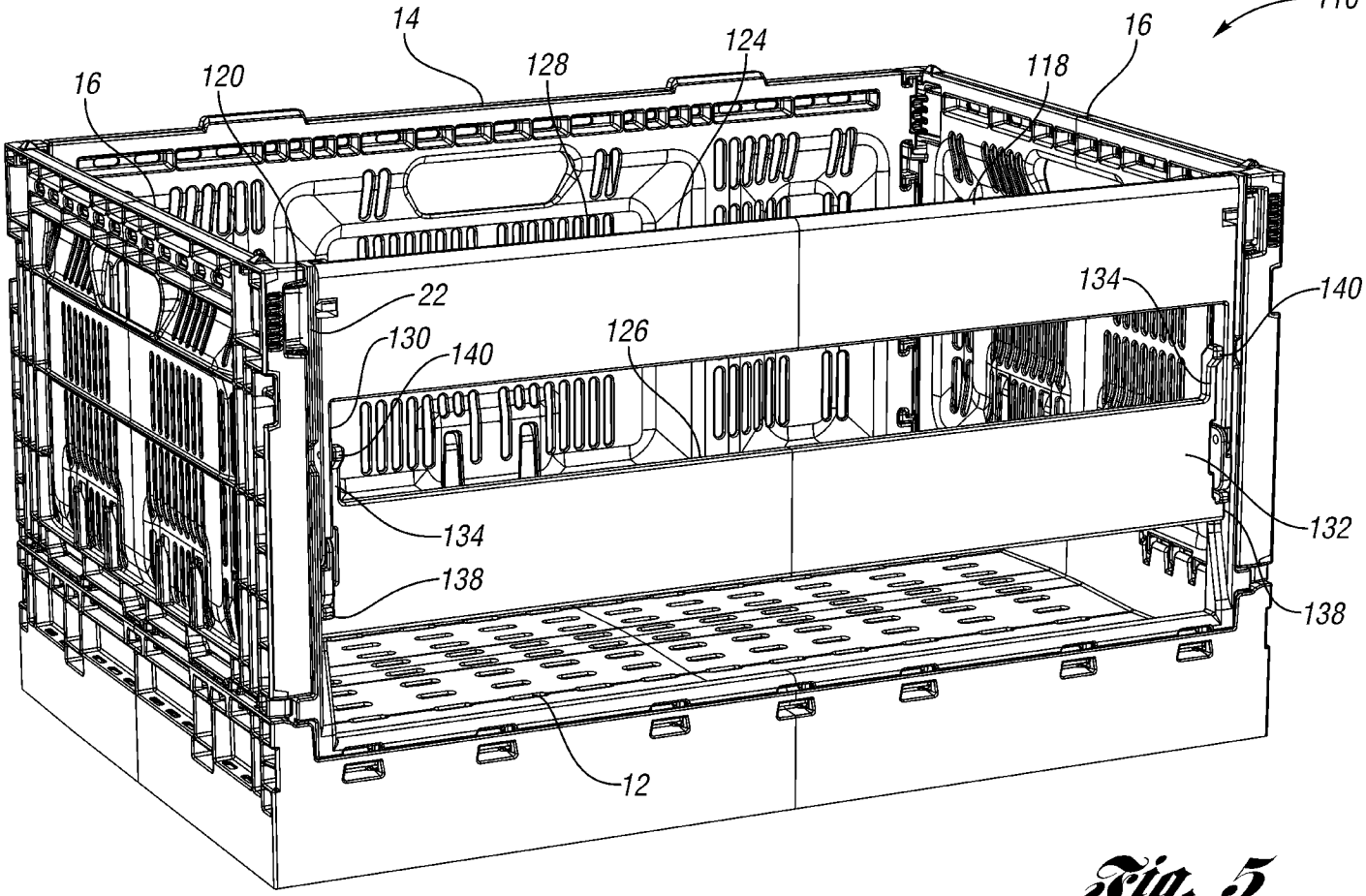
FIG. 5 is a perspective view of a crate according to another embodiment.

A collapsible container 110 according to a second embodiment is shown in FIGS. 5-9. In FIG. 5, the container 110 is in an upright, assembled position. The container 110 includes the same base 12, rear wall 14 and end walls 16 as in the first embodiment. A different front wall 118 is presented.

The front wall 118 includes a frame 120 pivotably connected to the base 12 and selectively connected to the end walls by latches 22. The front wall 118 further includes an upper (or "first") portion 124 and a lower (or "second") portion 126. The upper portion 124 includes a horizontal wall portion 128 and a pair of arms 130 extending downward from ends of the horizontal wall portion 128 (as an inverted U-shape). The lower portion 126 includes a horizontal wall portion 132 and a pair of arms 134 extending upward from ends of the horizontal wall portion 132, such that the lower portion 126 hangs from the hinges 140 at the upper ends of the arms 134 attached to a mid-point on the front of the arms 130 of the upper portion 124 (in an upright U-shape). The arms 130 of the upper portion 124 are pivotably connected to the frame 120 by hinges 138.

In FIG. 5, the walls are in their upright, use position. The front wall 118 is in its deployed, closed position, with the upper portion 124 and the lower portion 126 extending across an upper portion and a mid-portion, respectively, of a large opening defined by the frame 120. In the deployed, closed position, the front wall 118 keeps objects, such as egg cartons, in the container 110.

Figure 6:
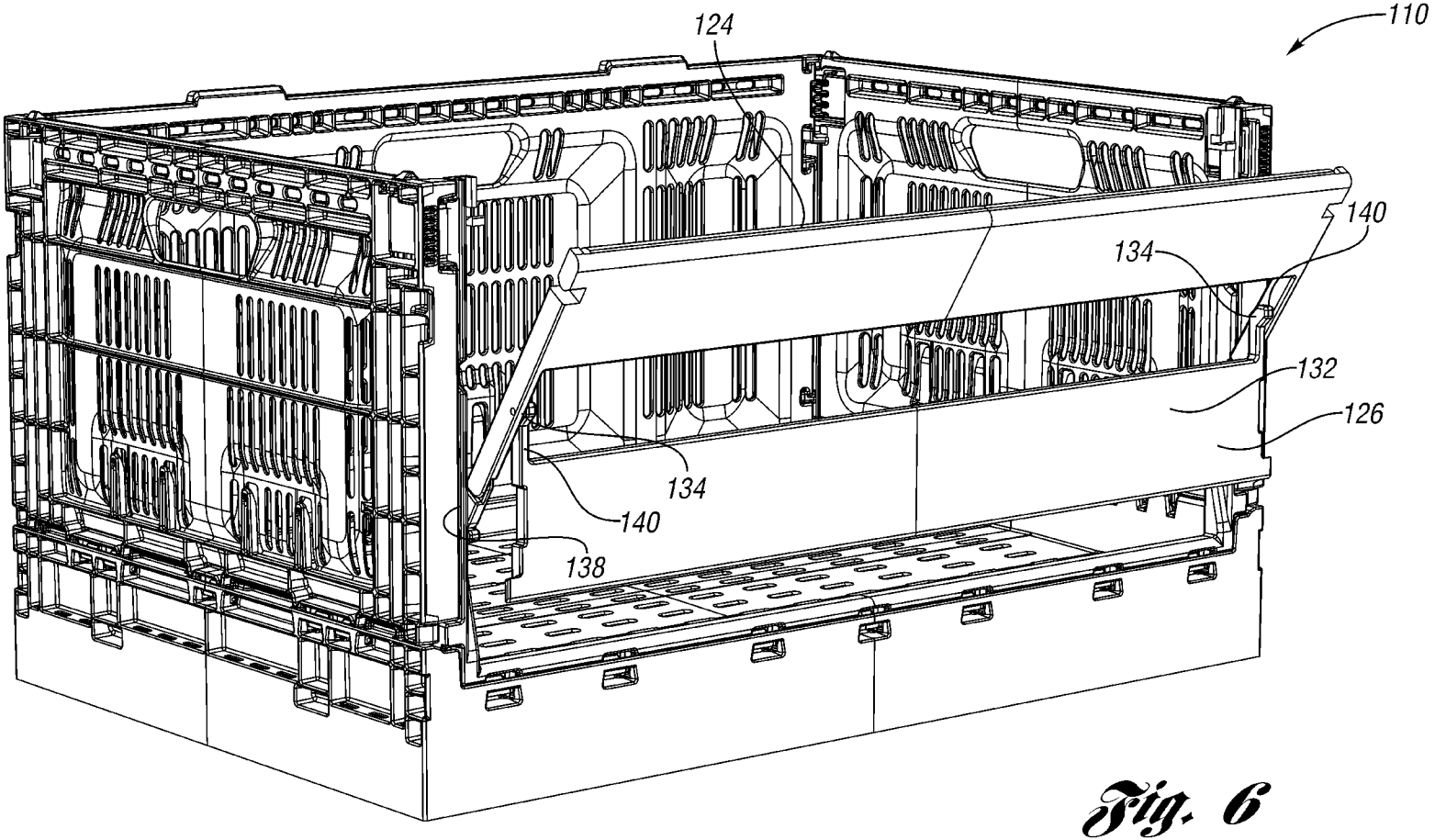
FIG. 6 shows the crate of FIG. 5 with the front wall pivoted slightly forward.
Figure 7:
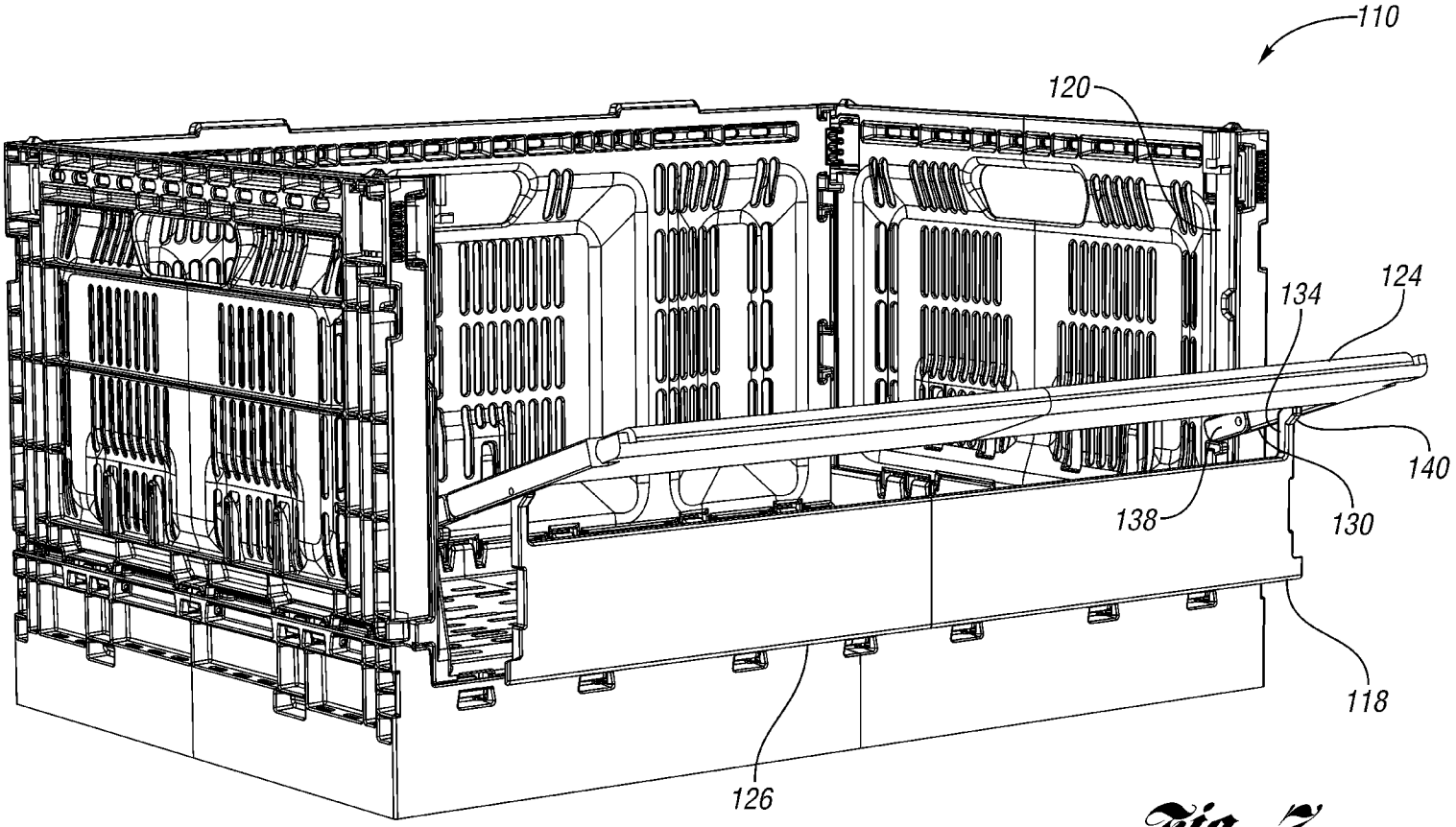
FIG. 7 shows the crate of FIG. 5 with the front wall pivoted more forward.

In FIG. 6, the upper portion 124 has been pivoted downward and forward slightly about hinges 138, such that lower portion 126 moves away from the rest of the container 10 and hangs down freely from the hinges 140. In FIG. 7, the upper portion 124 is pivoted forward and downward further.

Figure 8:
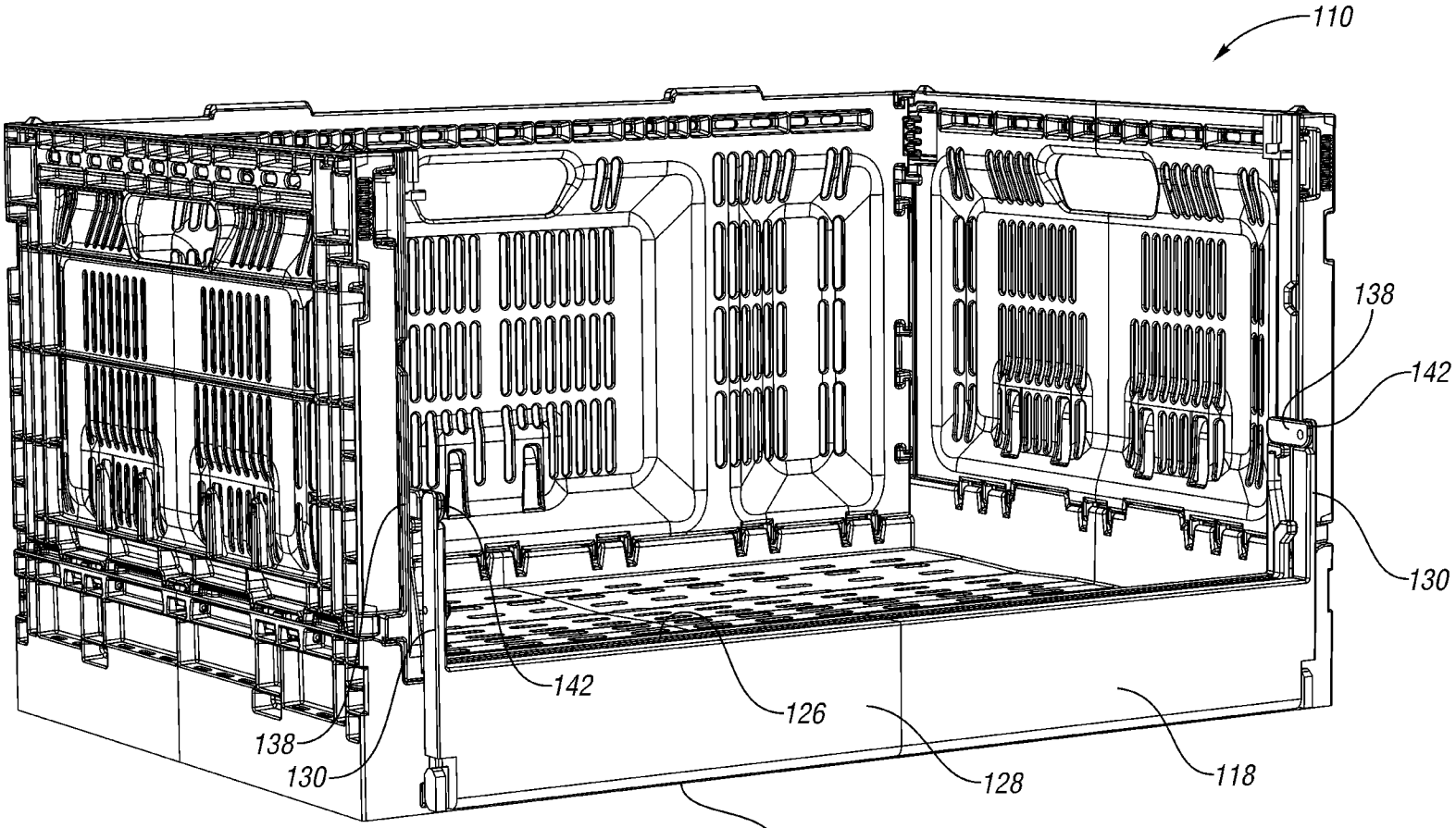
FIG. 8 shows the crate of FIG. 5 with the front wall in the retracted position.

In FIG. 8, the front wall 118 is shown in the retracted, open position. The upper portion 124 and the lower portion 126 are pivoted to a lower position, where the horizontal panel portions 128, 132 are positioned across the bottom of the front wall 118 (and the U-shapes of the upper portion 124 and lower portion 126 are aligned). The horizontal wall portion 132 of the lower portion 126 is substantially aligned with the horizontal wall portion 132 of the upper portion 124. In FIG. 8, the front wall 118 is in a retracted, open position, in which consumers can access the contents (such as egg cartons) of the container 110. Note that it is also possible to move the front wall 118 to the retracted, open position even when an identical container is stacked on the container 110.

Figure 9:
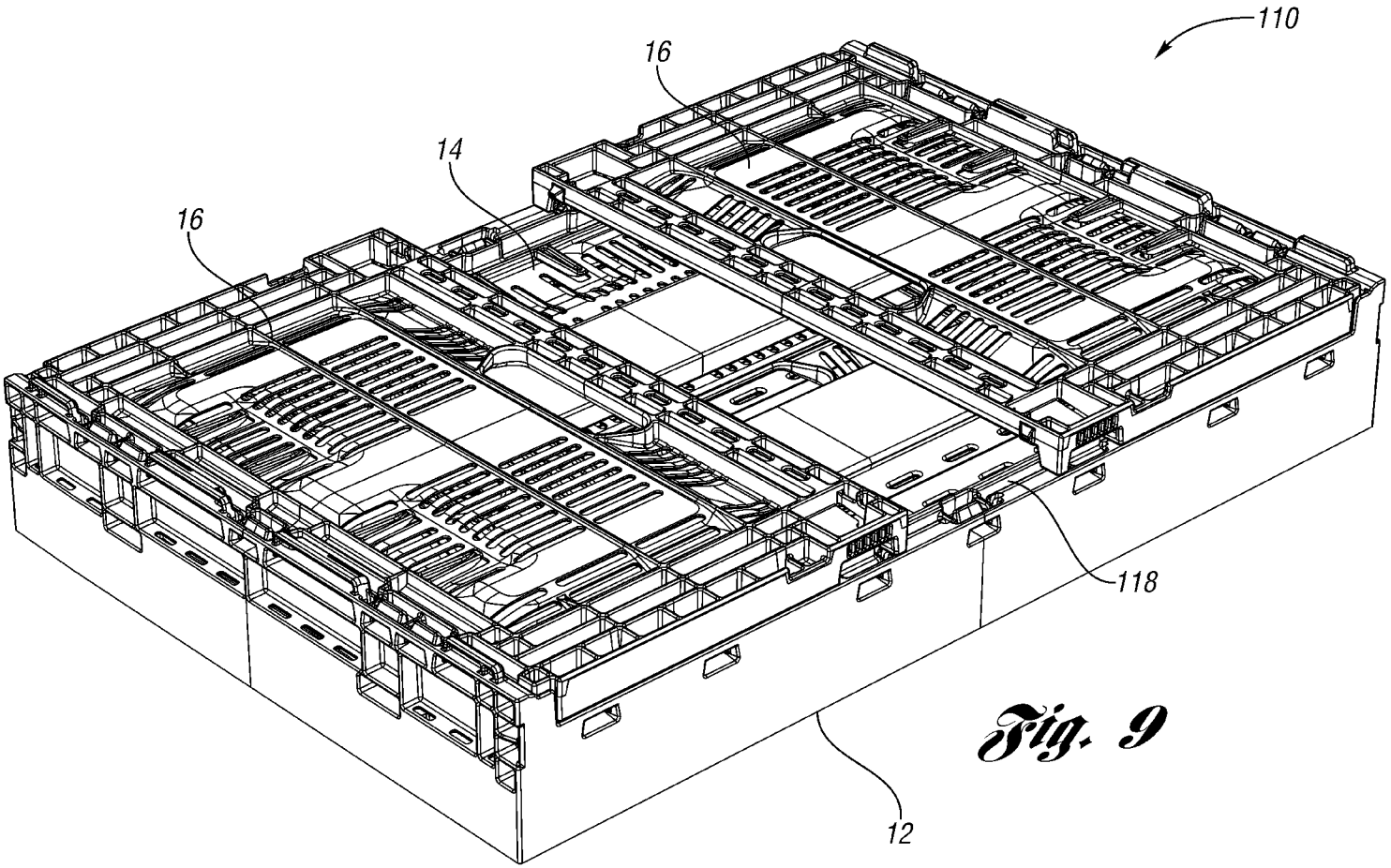
FIG. 9 shows the crate of FIG. 5 in the collapsed position.

When the container 110 is empty, the walls 14, 16, 118 can be collapsed onto the base 12 as shown in FIG. 9 for more efficient storage and shipping to be reused.

Figure 10:
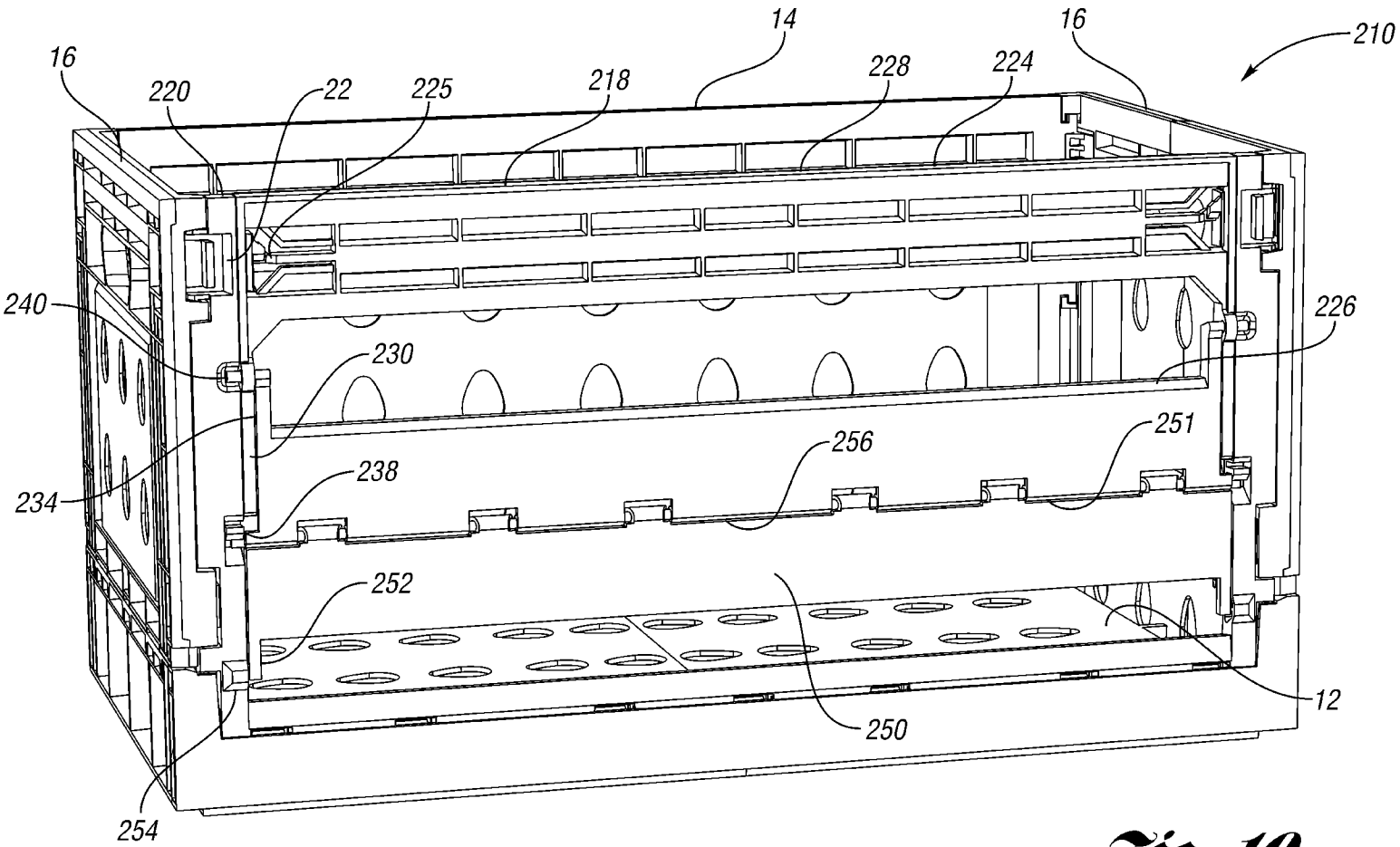
FIG. 10 is a perspective view of a crate according to another embodiment.

A container 210 according to a third embodiment is shown in FIGS. 10-13. In FIG. 10, the container 210 is in an upright, assembled position. The container 210 includes substantially the same base 12, rear wall 14 and end walls 16 as in the first two embodiments. A different front wall 218 is presented.

The front wall 218 includes a frame 220 pivotably connected to the base 12 and selectively connected to the end walls by latches 22. The front wall 218 further includes an upper (or "first") portion 224, a mid-portion (or "second" portion) 226 and a lower (or "third") portion 250. The upper portion 224 includes a horizontal wall portion 228 and a pair of arms 230 extending downward from ends of the horizontal wall portion 228 (in an inverted U-shape). The upper portion 224 is connected to the frame 220 by a latch 225. The mid-portion 226 includes a horizontal wall portion 232 and a pair of arms 234 extending upward from ends of the horizontal wall portion 232, such that the mid-portion 226 hangs from the hinges 240 at the upper ends of the arms 234 attached to a mid-point on the front of the arms 230 of the upper portion 224 (in an upright U-shape). The arms 230 of the upper portion 224 are pivotably connected to the frame 220 by hinges 238.

The lower portion 250 includes a horizontal wall portion 251 and a pair of arms 252 extending downward from ends of the horizontal wall portion 251 to hinges 254 at the lower ends of the arms 252 attached to the frame 220 (in an inverted U-shape). The upper edge of the lower portion 250 is connected to the lower edge of the mid-portion 226 by a hinge 256, such as a living hinge or a snap-fit hinge or other suitable hinge.

In FIG. 10, the walls are in their upright, use position. The front wall 218 is in its deployed, closed position, with the upper portion 224, the mid-portion 226 and the lower portion 250 extending across an upper portion, a mid-portion and a lower portion respectively, of a large opening defined by the frame 220. In the deployed, closed position, the front wall 218 keeps objects, such as egg cartons, in the container 210.

Figure 11:
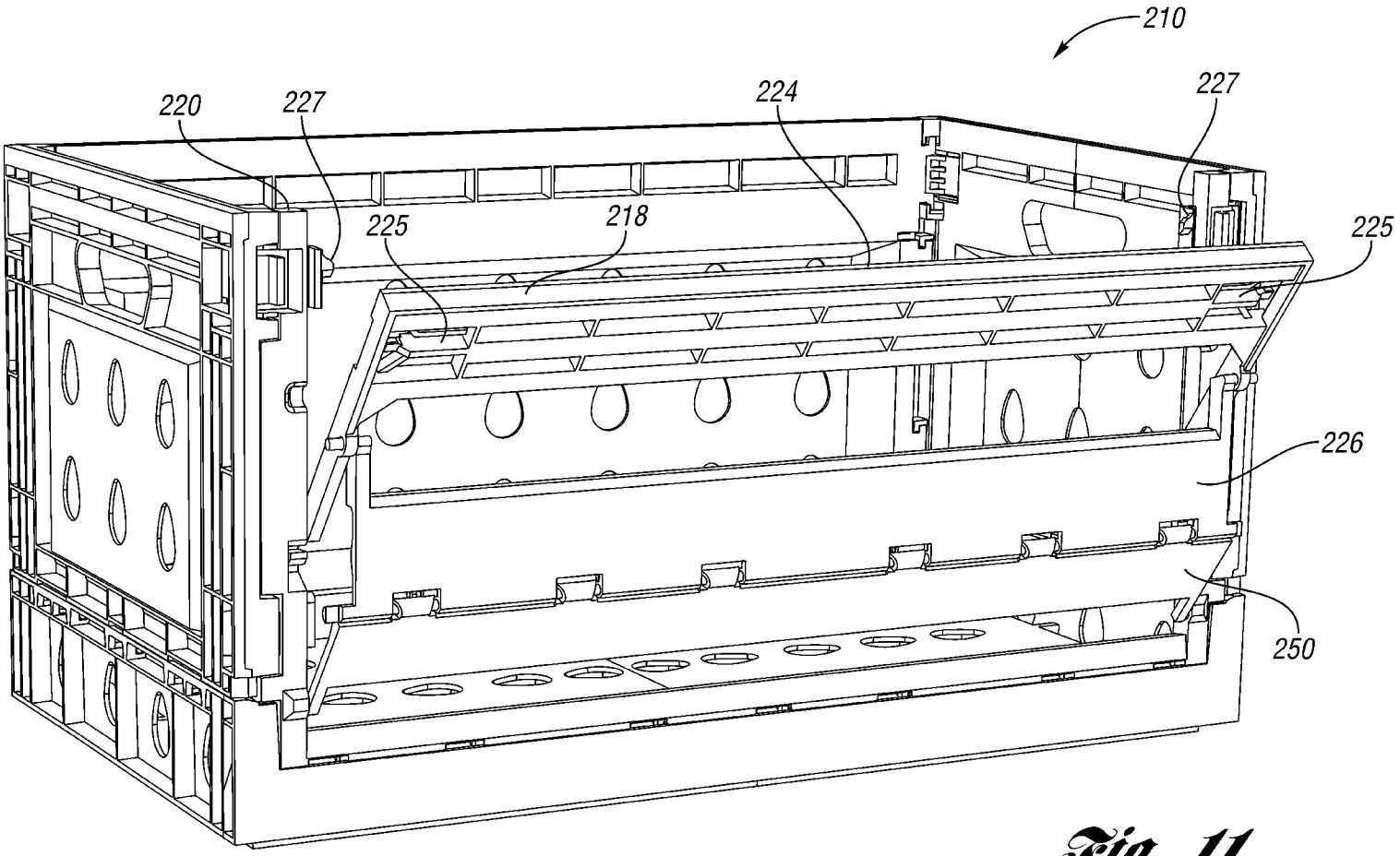
FIG. 11 shows the crate of FIG. 10 with the front wall pivoted slightly forward.

In FIG. 11, the upper portion 224 has been pivoted downward and forward slightly about hinges 238, such that mid-portion 226 and the lower portion 250 (particularly, the hinge 256) move away from the rest of the container 210. In this Figure, the complementary latch portion 227 to the latch 225 can be seen, the latch portion 227 on the frame 220 selectively connects the upper portion 224 to the frame 220.

Figure 12:
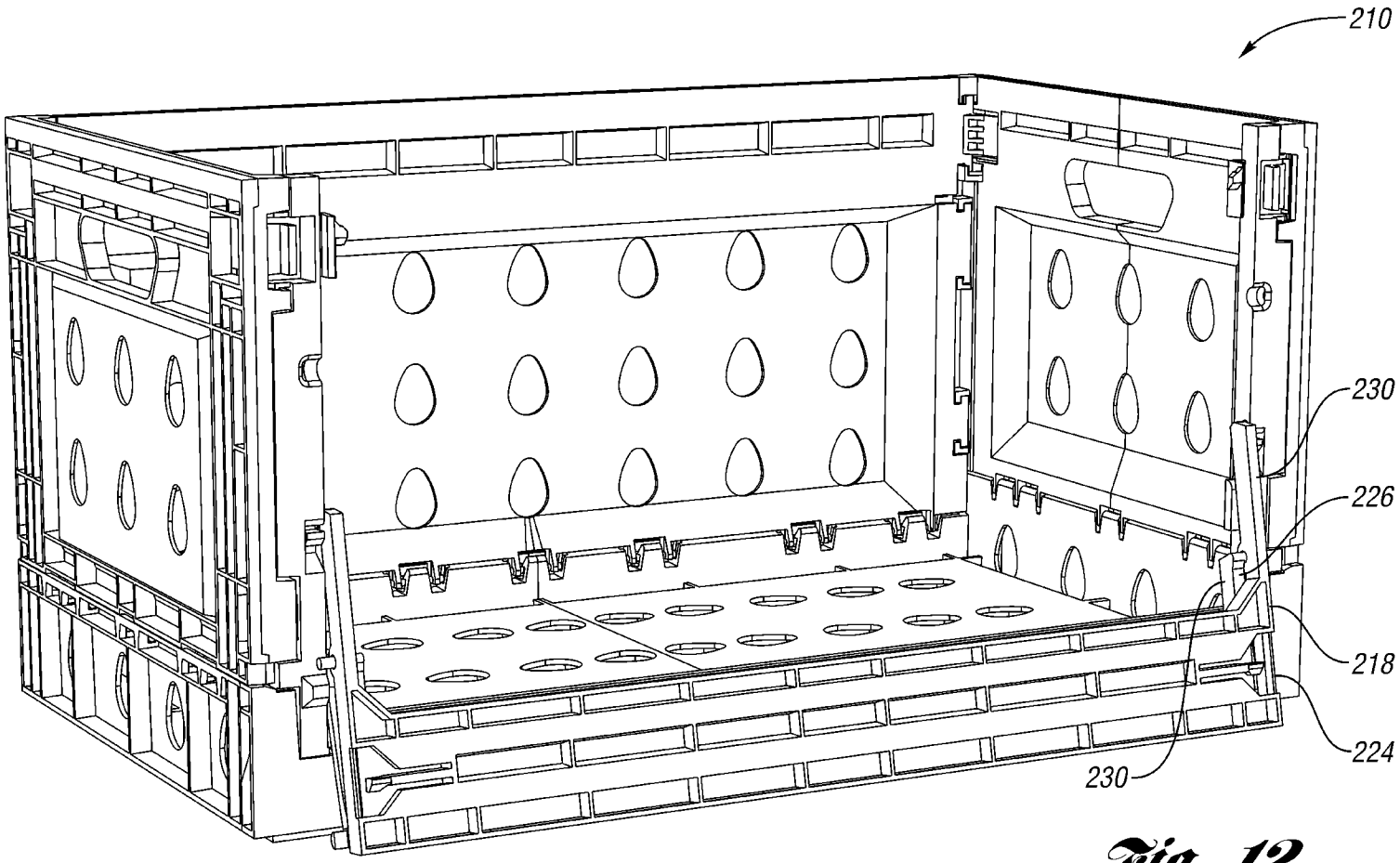
FIG. 12 shows the crate of FIG. 10 with the front wall near the retracted position.

In FIG. 12, the front wall 218 is shown close to the retracted, open position. The upper portion 224, the mid-portion 226 and the lower portion 250 are then pivoted to a lower position, where the horizontal panel portions 228, 232, 251 are positioned across the bottom of the front wall 218 (and the U-shapes are aligned). The horizontal wall portion 232 of the mid-portion 226 is substantially aligned with the horizontal wall portion 228 of the upper portion 224 and the horizontal wall portion 251 of the lower portion 250. The front wall 218 is in a retracted, open position, in which consumers can access the contents (such as egg cartons) of the container 210. Note that it is also possible to move the front wall 218 to the retracted, open position even when an identical container is stacked on the container 210.

Figure 13B:
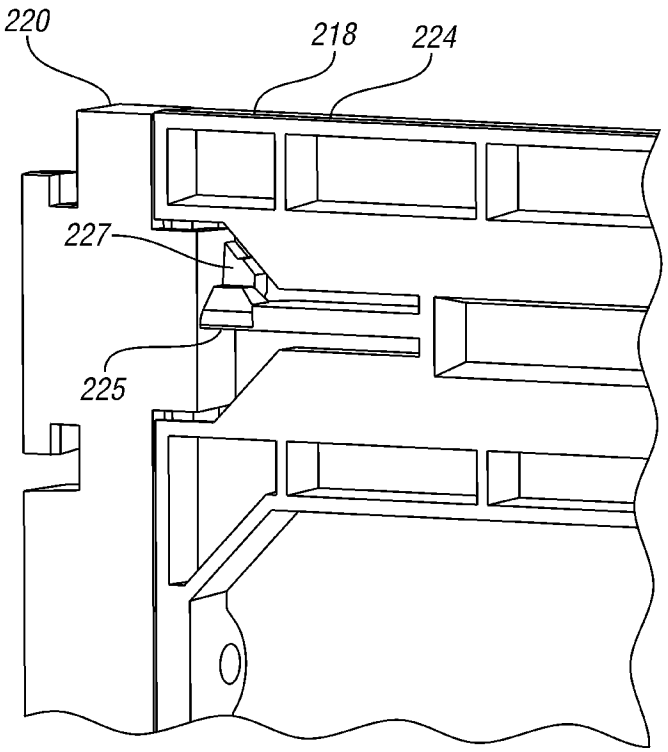
FIGS. 13A and 13 B are interior views of one of the latches connecting the upper portion of the front wall to the frame.
Figure 13A:
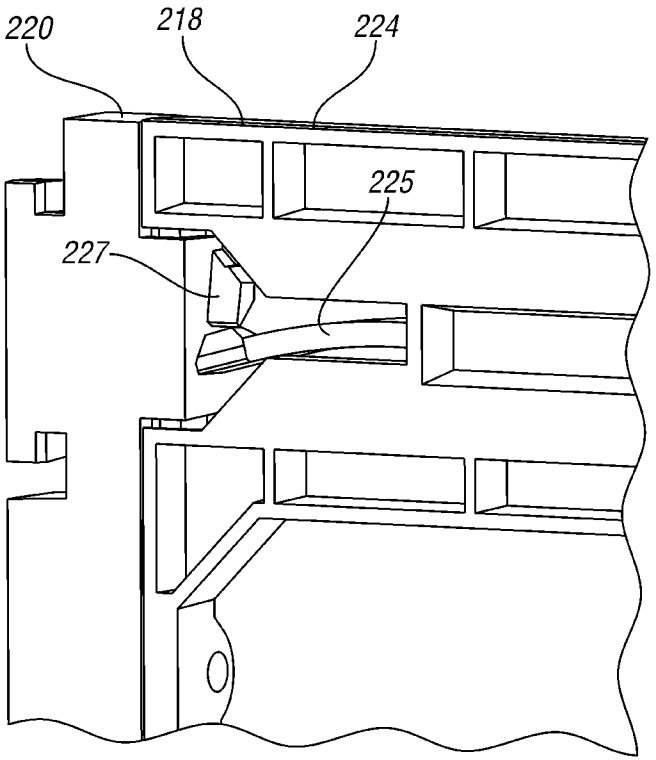

FIGS. 13A and 13B are interior views of one of the latches connecting the upper portion 224 of the front wall 218 to the frame 220. As shown, the latch 225 of the upper portion 224 selectively connects to the latch portion 227 on the frame 220.

When the container 210 is empty, the walls 14, 16, 218 can be collapsed onto the base 12 for more efficient storage and shipping to be reused.

A collapsible crate 310 according to another embodiment of the present invention is shown in FIGS. 14-18. The crate 310 includes a base 312, a rear wall 314, a front wall 316 and end walls 318. The rear wall 314 and end walls 318 are pivotably connected to the base 312, such that they can be selectively collapsed onto the base 312 in a known manner (with appropriate hinges, latches, etc.).

Figure 14:
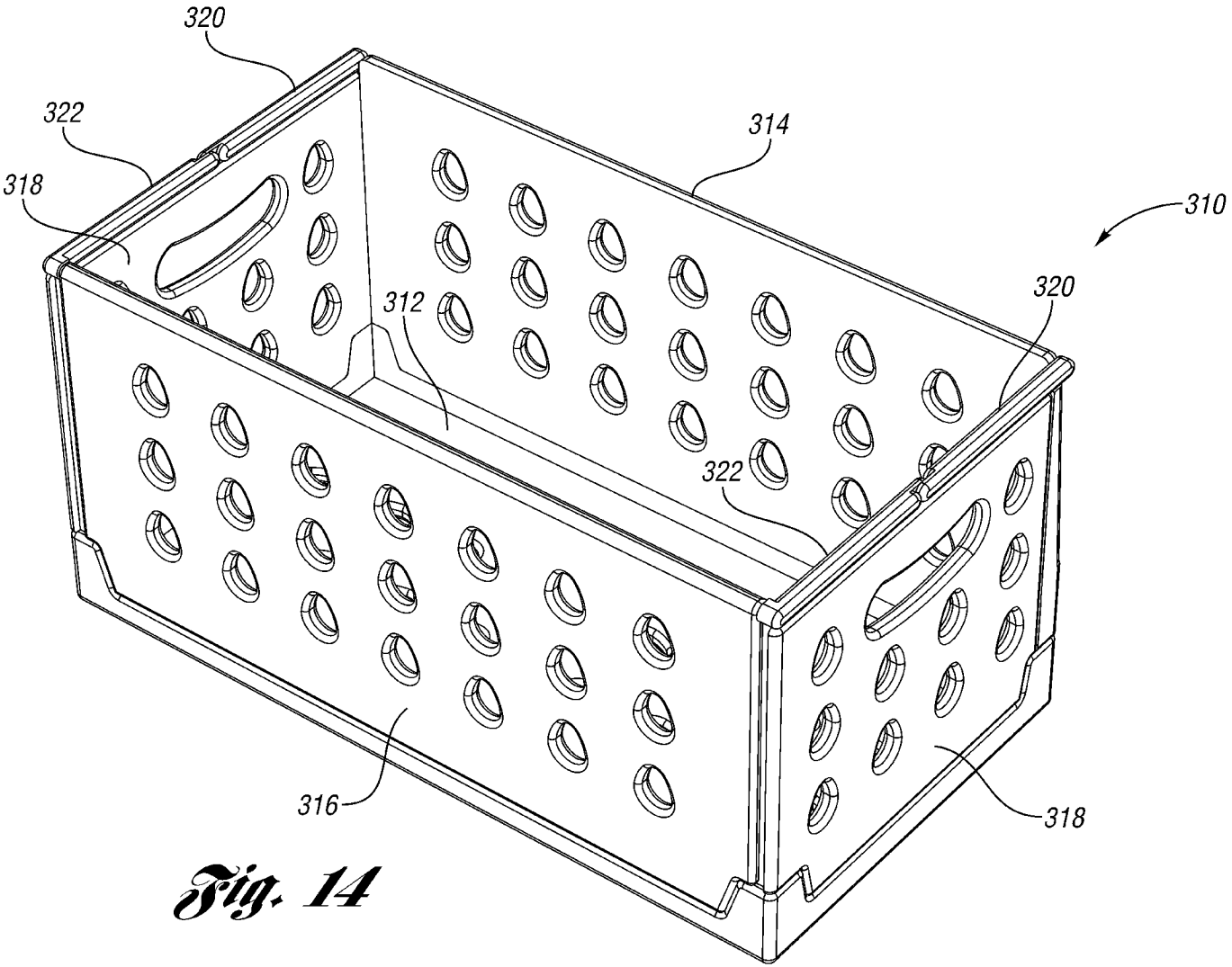
FIG. 14 is a perspective view of a crate according to another embodiment.

The rear wall 314 is pivotably connected at its upper edge to a pair of first arms 320, which in turn are pivotably connected to a pair of second arms 322, which are connected to an upper edge of the front wall 316. There may be latches or other means for releasably securing the front wall 316 to the end walls 318 and/or the base 312. The first and second arms 320, 322 rest on the upper edges of the end walls 318 and may be received in a recess or channel there. In FIG. 14, the crate 310 is shown in the assembled, shipping position with the walls 314, 316, 318 in the upright position relative to the base 312.

Figure 15:
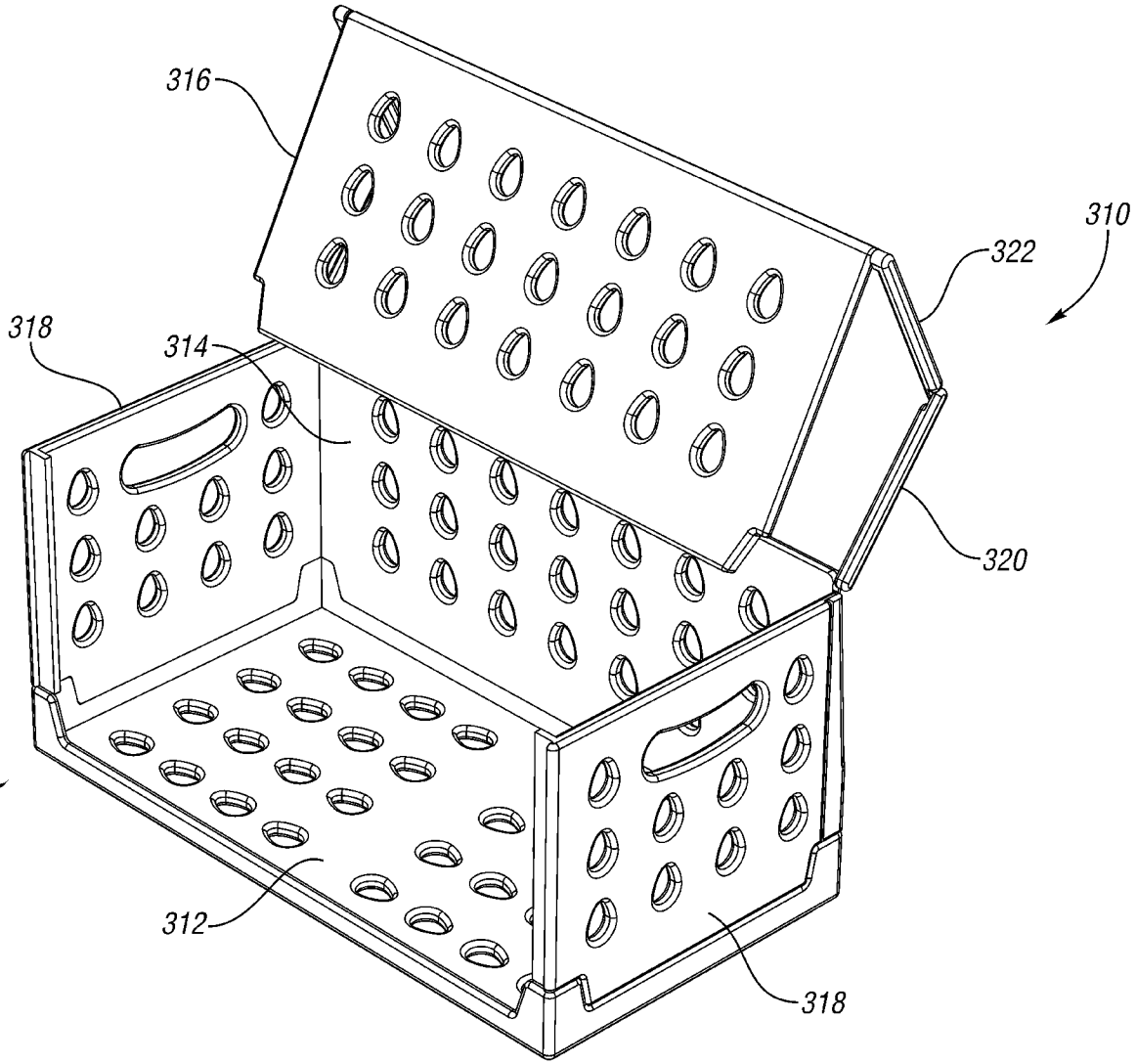
FIG. 15 shows the crate of FIG. 14 with the front wall pivoted rearward.
Figure 16:
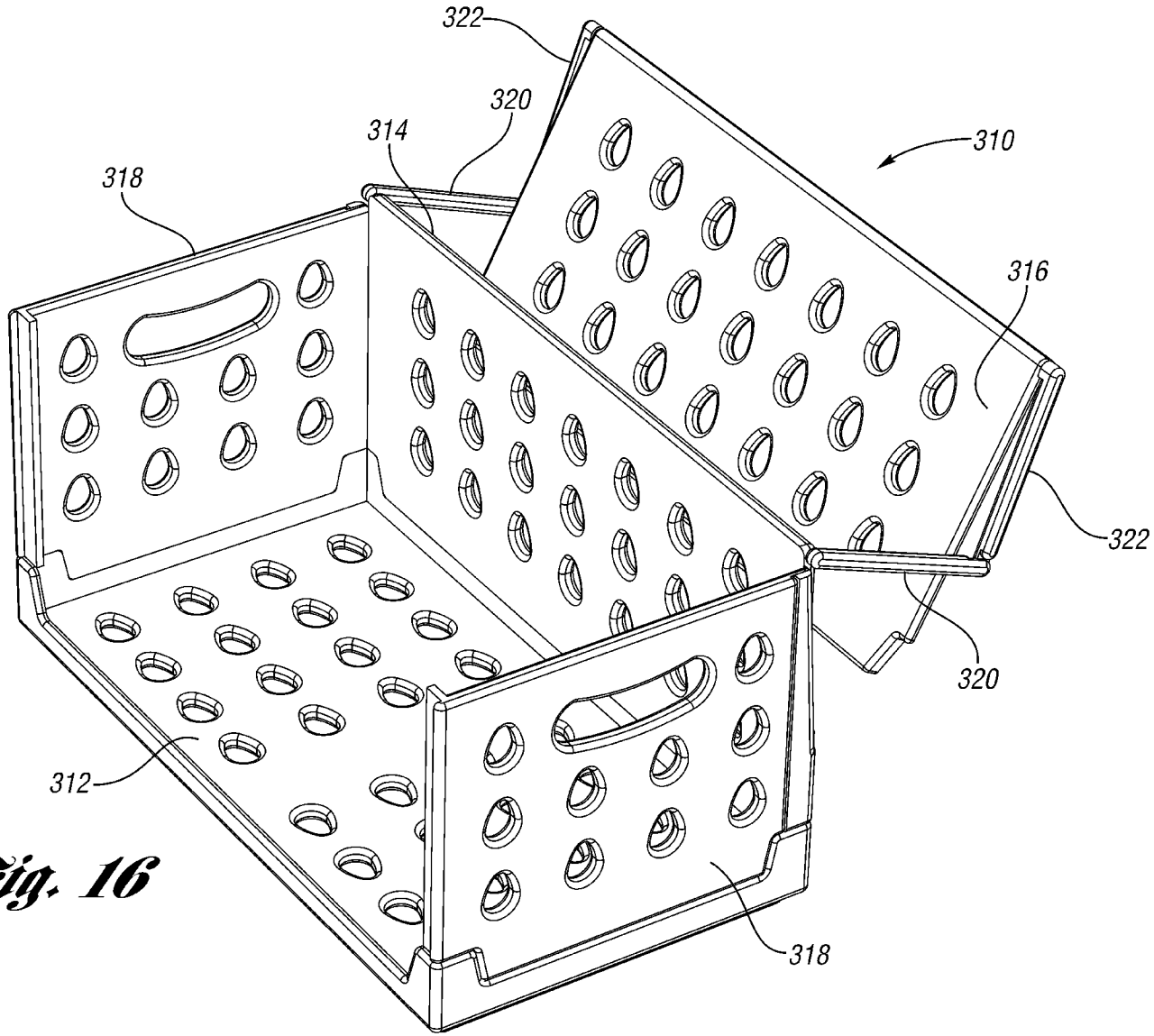
FIG. 16 shows the crate of FIG. 14 with the front wall pivoted more rearward.
Figure 17:
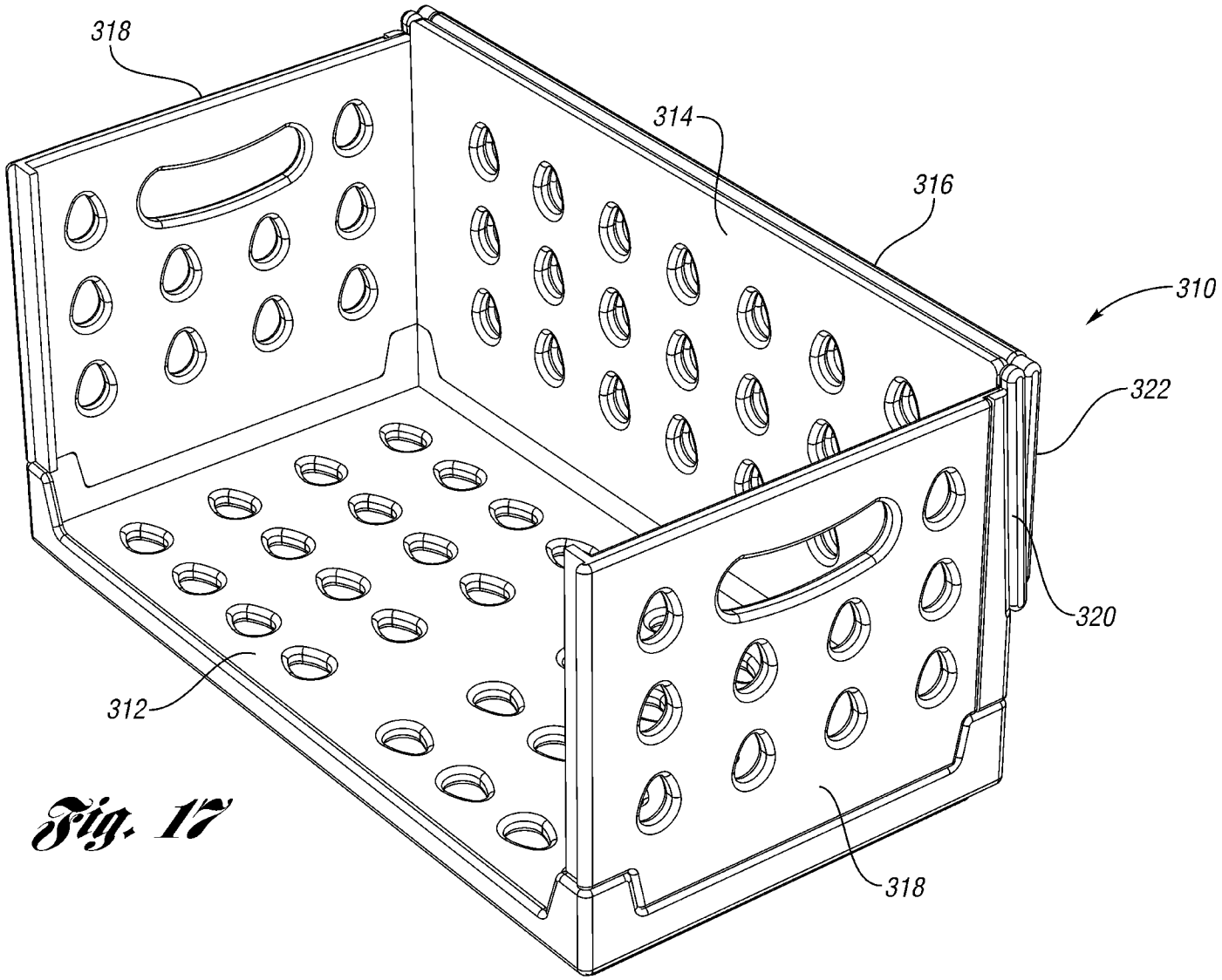
FIG. 17 shows the crate of FIG. 14 with the front wall in the retracted position.

Referring to FIGS. 15-16, the front wall 316 can be retracted from its upright position by lifting the front wall 316 and pivoting the first arms 320 and the second arms 322 rearward. As shown in FIG. 16, the front wall 316 swings through the first arms 320 and second arms 322 to a position behind the rear wall 314. The front wall 316 can then be brought to its retracted position as shown in FIG. 17, where the front wall 316 abuts the outer surface of the rear wall 314. The first and second arms 320, 322 are folded together and received in a recess at the upper rear edge of each end wall 318.

Figure 18:
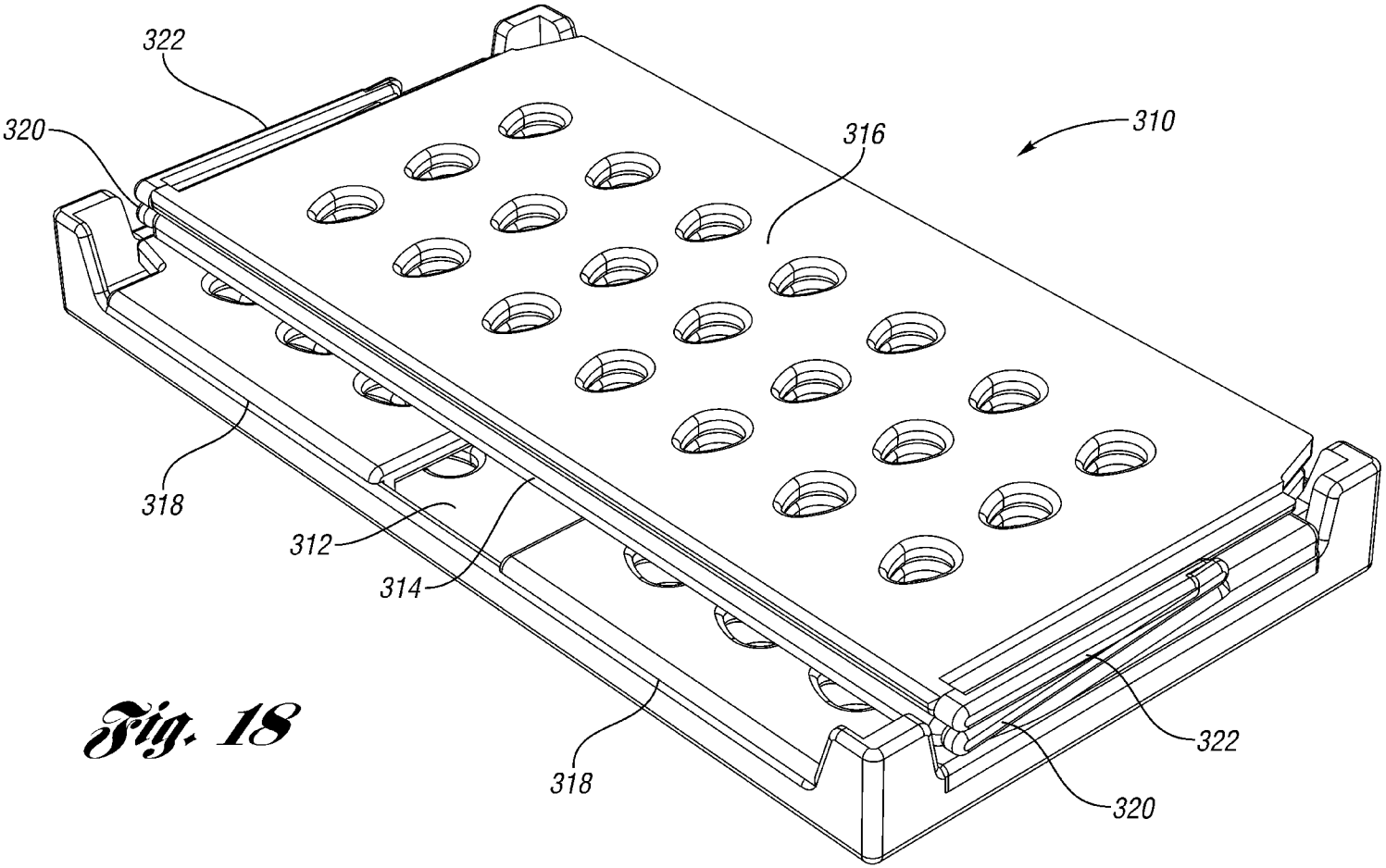
FIG. 18 shows the crate of FIG. 14 in the collapsed position.
Figure 19:
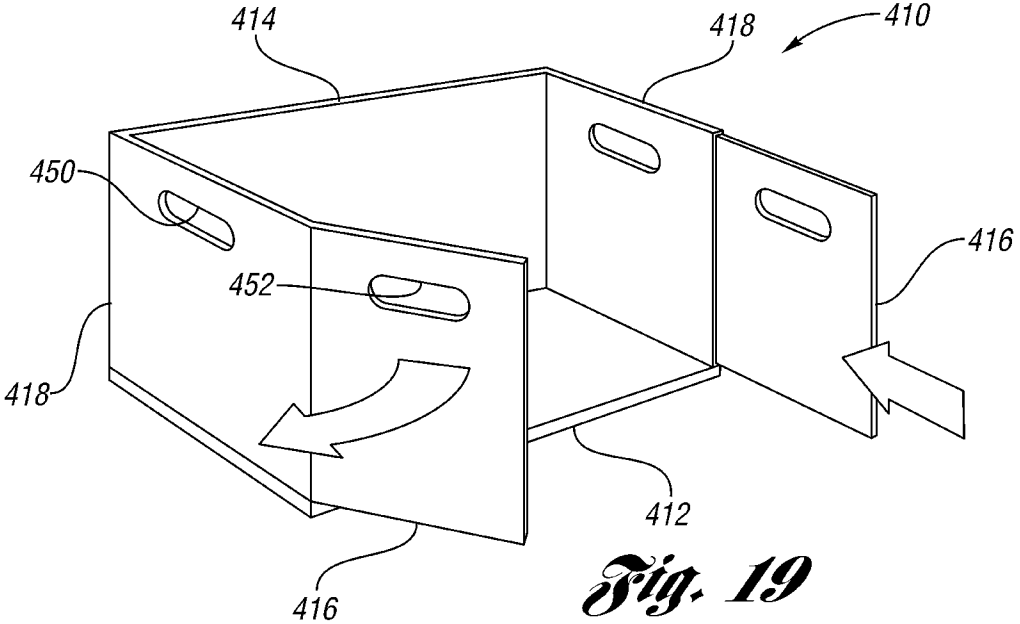
FIG. 19 is a perspective view of a crate according to another embodiment with the front wall partially open.

In this manner, a crate 310 loaded with goods for sale, such as egg crates, could be shipped to a store. At the store, the front wall 316 can be moved from the upright, shipping position of FIG. 14 to the retracted position of FIG. 17 where customers can view, select and remove the goods from the crate 310. The goods therefore do not need to be removed from the crate 310 by workers at the store. When the crate 310 is empty, the end walls 318 are pivoted down onto the base 312 as shown in FIG. 18. The rear wall 314 and front wall 316 are pivoted down together onto the base 312 and end walls 318 to the collapsed position as shown in FIG. 6. In the collapsed position, empty crates 310 can more efficiently be stored and then shipped back to the warehouse where they can be reused.

A collapsible crate 410 according to another embodiment of the present invention is shown in FIGS. 19-23. The crate 410 includes a base 412, a rear wall 414, a pair of front wall portions 416 and end walls 418. The rear wall 414 and end walls 418 are pivotably connected to the base 412, such that they can be selectively collapsed onto the base 412 in a known manner (with appropriate hinges, latches, etc.).

Figure 20:
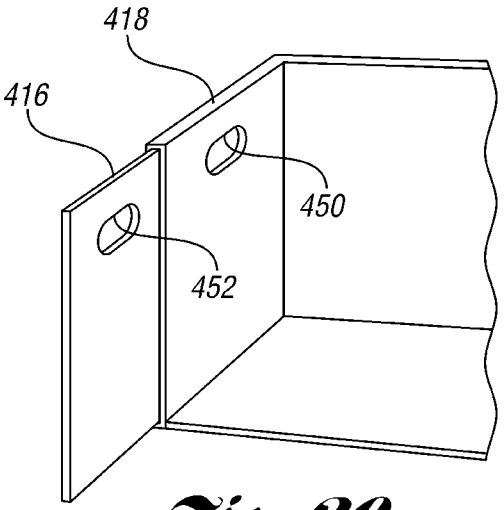
FIG. 20 is an enlarged view showing one of the walls of the crate of FIG. 19 being retracted.
Figure 22:
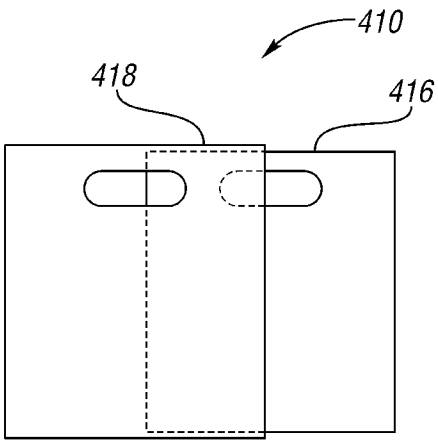
FIG. 22 is a side view showing one of the walls of the crate of FIG. 19 being retracted further.
Figure 21:
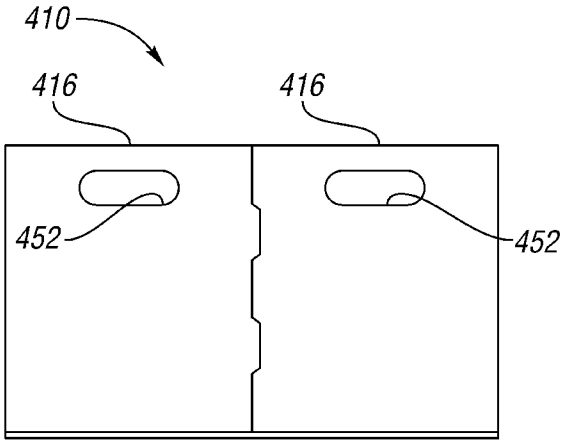
FIG. 21 is a side view showing one of the walls of the crate of FIG. 19 being retracted.
Figure 23:
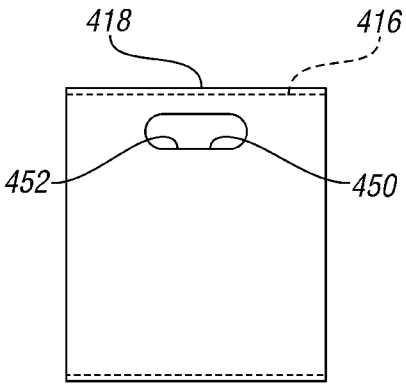
FIG. 23 is a side view showing the side wall of the crate in the retracted position.
Figure 24:
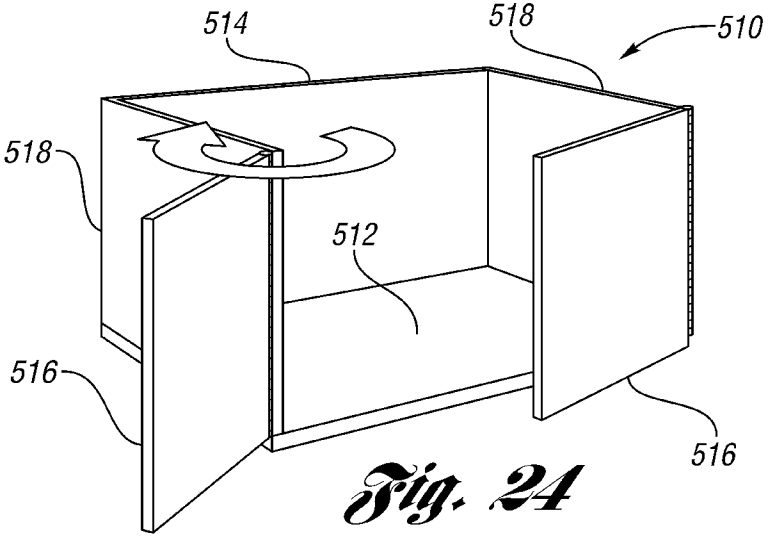
FIG. 24 is a perspective view of a crate according to another embodiment with the front wall partially open.
Figure 25:
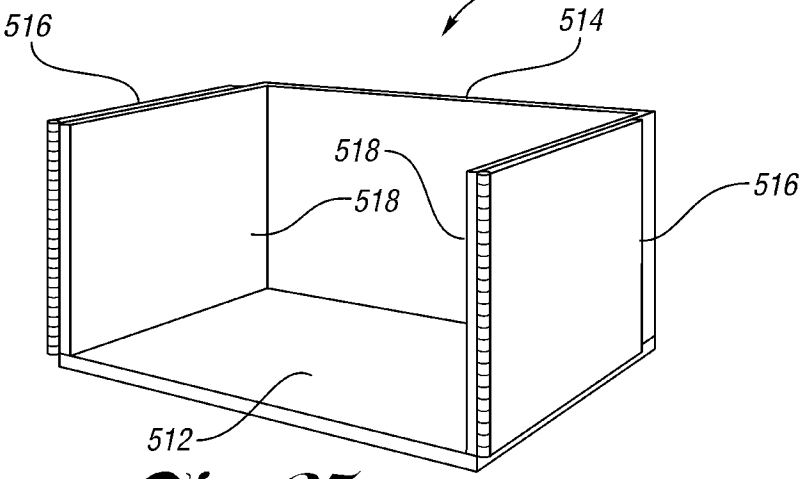
FIG. 25 shows the crate of FIG. 24 with the front walls completely open.
Figure 26:
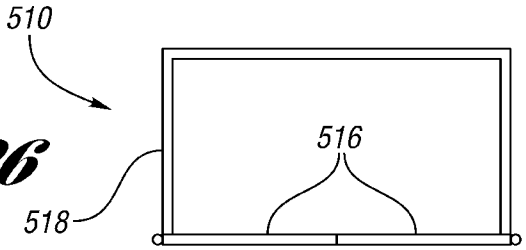
FIG. 26 is a top view of the crate of FIG. 24 with the front walls closed.
Figure 27:
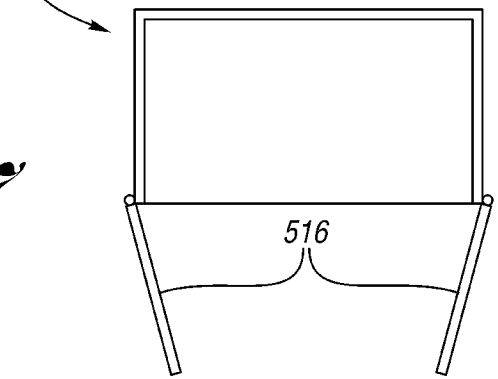
FIG. 27 is a top view of the crate of FIG. 24 with the front walls partially open.
Figure 28:
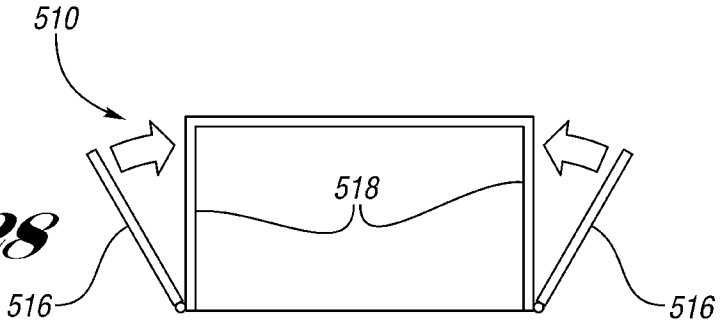
FIG. 28 is a top view of the crate of FIG. 25 with the front walls more open.

The front wall portions 416 are each pivotably and slidably connected to the adjacent end walls 418. Each of the end walls 418 includes a handle opening 450. Each of the front wall portions 416 includes a handle opening 452. As shown in FIGS. 20-21, after the front wall portion 416 is pivoted outward, it can slide into the adjacent end wall 418 (or along the outside of end wall 418). FIGS. 22-23 show that the handle opening 452 of the front wall portion 416 aligns with the handle opening 450 of the end wall 418 when the front wall portion 416 is retracted into (or adjacent) the end wall 418. Thus, the handles 450, 452 can be used to lift the crate 410 when the front wall portions 416 are retracted.

Retraction of the front wall portions 416 provides access to the crate 410 interior. When empty, the crate 410 can be collapsed by pivoting the rear wall 414 and end walls 418 (with the front wall portions 416 inside or adjacent) onto the base 412.

FIGS. 24-28 illustrate a crate 510 according to another embodiment of the present invention. The crate 510 includes a base 512 with rear 514 and end walls 518 pivotably mounted thereto. Front walls 516 are hingeably connected to adjacent end walls 518 such that the front walls 516 could be selective pivoted back to a position adjacent and abutting the end walls 518. This provides increased access to the crate 510 interior. When empty, the walls 514, 518 and 516 can be pivoted to a collapsed position on the base 512.

A collapsible crate 610 according to another embodiment of the present invention is shown in FIGS. 29-32. The crate 610 includes a base 612, a rear wall 614, a front wall 616 and end walls 618. The rear wall 614 and end walls 618 are pivotably connected to the base 612, such that they can be selectively collapsed onto the base 612 in a known manner (with appropriate hinges, latches, etc.).

Figure 29:
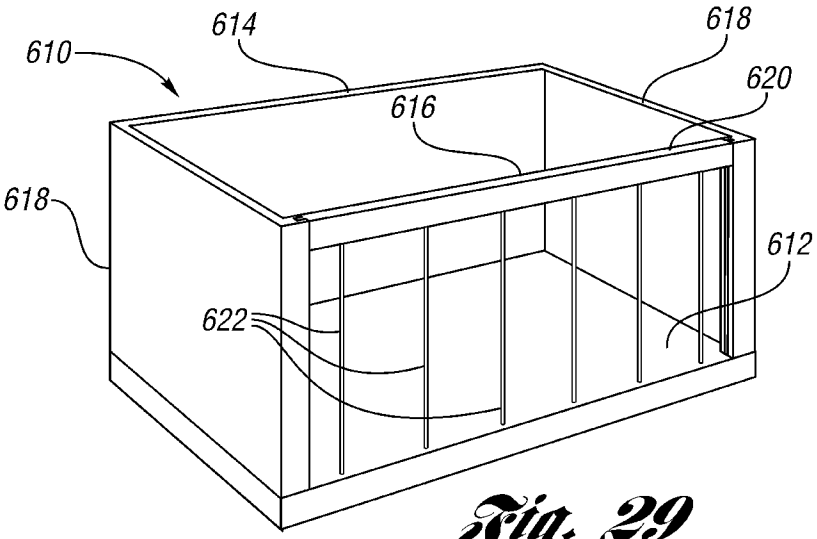
FIG. 29 is a perspective view of a crate according to another embodiment.

Front wall 616 includes an upper rail 620 and a plurality of elastic or resilient cords 622. The cords 622 are attached to the upper rail 620 and extend down to the base 612. In FIG. 29, the cords 622 are shown stretched tightly from the base 612 to the upper rail 620, where the upper rail 620 is at its upper, closed position at the top of the crate 610.

Figure 30:
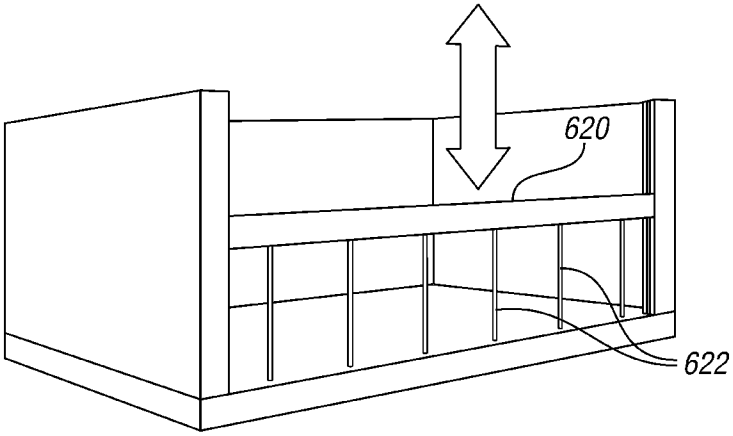
FIG. 30 shows the crate of FIG. 29 with the front wall being moved toward a retracted position.

As shown in FIG. 30, the upper rail 620 can be slid down to provide increased access to the crate 610. The upper rail 620 can be slid down onto the base 612. The cords 622 retract back to their unstretched size, so that they are not in the way.

Figure 31:
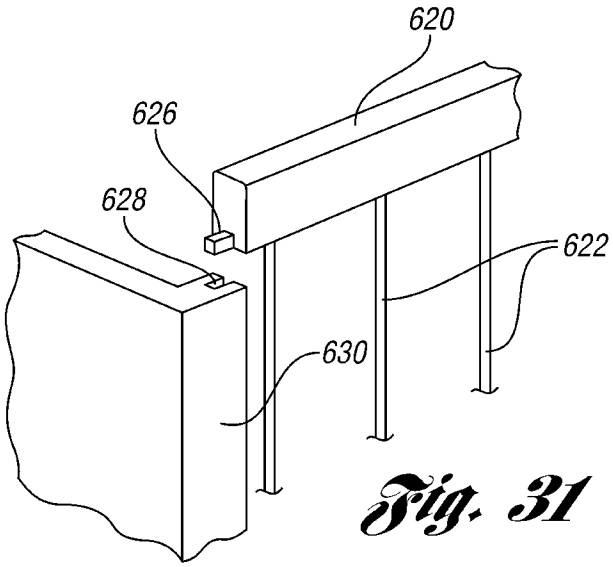
FIG. 31 is an enlarged view of a top front corner of the crate of FIG. 29.

FIG. 31 shows more detail of the top of the crate 610. Each end of the upper rail 620 includes a hook 626 that is received in a recess 628 at the top of a flange 630 from the end wall 618. This retains the upper rail 620 selectively at the top of the crate 610.

Figure 32:
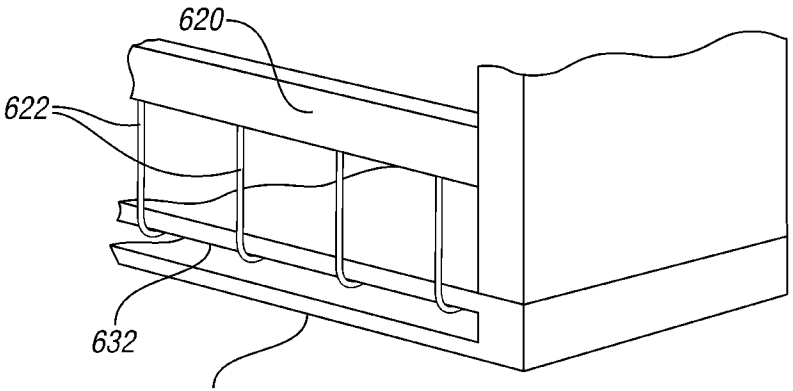
FIG. 32 is an enlarged view of the base of the crate of FIG. 29.

FIG. 32 shows more detail of the front of the base 612 of the crate 610. The base includes a front opening 632 into which the cords 622 extend. The cords 622 are attached inside the base 612 (in the middle or at the rear, depending on how much distance is needed so that the cords 622 will retract into the base without hanging down).

In this manner, a crate 610 loaded with goods for sale, such as egg crates, could be shipped to a store. At the store, the upper rail 620 can be moved from the upper, shipping position of FIG. 29 where the cords 622 retain the goods in the crate 610 to the retracted position on the base 612 where customers can view, select and remove the goods from the crate 610. The goods therefore do not need to be removed from the crate 610 by workers at the store.

When the crate 610 is empty, the end walls 618 are pivoted down onto the base 612. In the collapsed position, empty crates 610 can more efficiently be stored and then shipped back to the warehouse where they can be reused.

Figure 33:
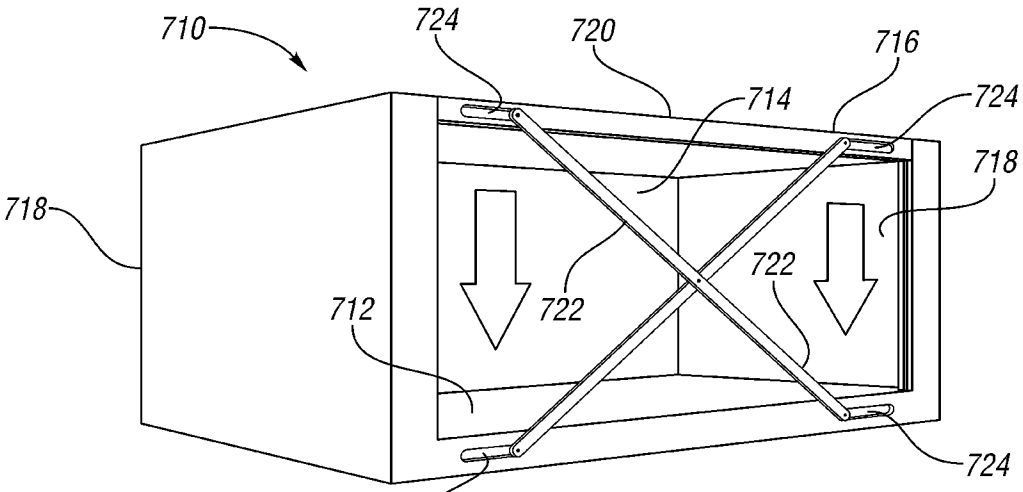
FIG. 33 is a perspective view of a crate according to another embodiment.
Figure 34:
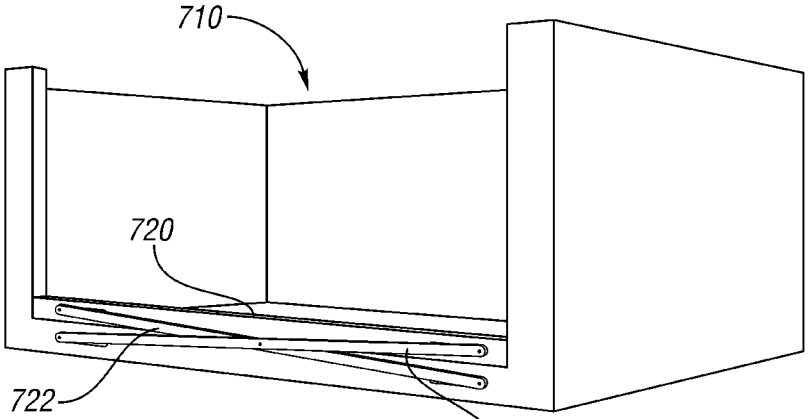
FIG. 34 shows the crate of FIG. 33 with the front wall in a retracted position.

A collapsible crate 710 according to another embodiment of the present invention is shown in FIGS. 33-34. The crate 710 includes a base 712, a rear wall 714, a front wall 716 and end walls 718. The rear wall 714 and end walls 718 are pivotably connected to the base 712, such that they can be selectively collapsed onto the base 712 in a known manner (with appropriate hinges, latches, etc.).

The front wall 716 includes an upper rail 720 slidably connected to the end walls 718. Two braces 722 are pivotably connected to one another near their middle. The braces 722 are pivotably and slidably connected at their upper ends to channels 724 in the upper rail 720 and at their lower ends to channels 724 in the base 712 (or a flange extending upward from a front of the base 712).

In FIG. 33, the front wall 716 is shown in its upright, closed position. In this position, the goods can be shipped to the store in the crate 710. At the store, the front wall 716 can be retracted to the position shown in FIG. 3, so that customers can easily access the goods directly from the crate 710. When empty, the walls of the crate 710 can be collapsed onto the base 712 for more efficient storage and shipping.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible crate comprising:

a base;

a rear wall pivotably connected to the base such that the rear wall can be selectively moved between an upright position and a collapsed position on the base;

a pair of opposed end walls pivotably connected to the base such that the pair of opposed end walls can be selectively moved between an upright position and a collapsed position on the base; and a front wall, wherein the front wall is movable between a retracted, open position and a closed position while the front wall, the rear wall and the pair of opposed end walls are in an upright position relative to the base, wherein the front wall includes an upper rail slidable in a front plane between the retracted, open position proximate the base and the closed position proximate an upper edge of the crate, wherein the upper rail is proximate uppermost edges of the pair of opposed end walls when the upper rail is in the closed position and wherein the upper rail is spaced downward away from the uppermost edges of the pair of opposed end walls when the upper rail is in the open, retracted position, the front wall further including a plurality of braces extending upward at angles to the upper rail when the front wall is in the closed position, wherein the braces are pivotably connected at upper ends to the upper rail, wherein the braces are pivotable relative to the upper rail about axes that are generally perpendicular to the front plane.

2. The collapsible crate of claim 1 wherein the braces are pivotable about lower ends thereof.

3. The collapsible crate of claim 2 wherein the braces are pivotable and slidable about the lower ends thereof.

4. The collapsible crate of claim 3 wherein the braces are pivotably connected to one another between the upper ends thereof and lower ends thereof.

5. The collapsible crate of claim 1 wherein the braces are pivotably connected to one another between the upper ends thereof and lower ends thereof.

6. The collapsible crate of claim 1 wherein the braces are pivotably and slidably connected at the upper ends of the braces to the upper rail.

7. The crate of claim 1 wherein the braces are pivotable in the front plane.

8. A collapsible crate comprising:

a base;

a first wall pivotably connected to the base such that the first wall can be selectively moved between an upright position and a collapsed position on the base, wherein the first wall includes an upper rail slidable between a retracted, open position proximate the base and a closed position proximate an upper edge of the crate while the first wall is in the upright position, the first wall including a plurality of braces extending upward to the upper rail when the first wall is in the closed position, wherein the braces are pivotably connected at upper ends to the upper rail, wherein the braces are pivotable relative to the upper rail about axes that are generally perpendicular to a first plane; and a pair of opposed walls pivotably connected to the base such that the pair of opposed walls can be selectively moved between an upright position and a collapsed position on the base, wherein the first plane is perpendicular to the base and perpendicular to the pair of opposed walls in the upright position, wherein the upper rail is proximate uppermost edges of the pair of opposed end walls when the upper rail is in the closed position and wherein the upper rail is spaced downward away from the uppermost edges of the pair of opposed end walls when the upper rail is in the open, retracted position.

9. The collapsible crate of claim 8 wherein the braces are pivotable about lower ends thereof.

10. The collapsible crate of claim 9 wherein the braces are pivotable and slidable about the lower ends thereof.

11. The collapsible crate of claim 10 wherein the braces are pivotably connected to one another between the upper ends thereof and lower ends thereof.

12. The collapsible crate of claim 8 wherein the braces are pivotably connected to one another between the upper ends thereof and lower ends thereof.

13. The collapsible crate of claim 8 wherein the braces are pivotably and slidably connected at the upper ends of the braces to the upper rail.

14. The collapsible crate of claim 8 wherein the braces are pivotable in the first plane about the axes.

15. A crate with a retractable wall comprising:

a base having opposed front and rear edges and opposed end edges;

a pair of opposed end walls extending upward from the opposed end edges of the base;

a rear wall extending upward from the rear edge of the base; and a front wall extending upward from the front edge of the base, an upper rail slidable in a front plane relative to the pair of opposed end walls between a retracted, open position proximate the base and a closed position proximate an upper edge of the crate, wherein the upper rail is proximate uppermost edges of the pair of opposed end walls when the upper rail is in the closed position and wherein the upper rail is spaced downward away from the uppermost edges of the pair of opposed end walls when the upper rail is in the open, retracted position, the front wall including a plurality of braces extending upward to the upper rail when the front wall is in the closed position, wherein upper ends of the braces are pivotably connected to the upper rail and wherein the braces are configured to pivot in the front plane as the upper rail is slid between the retracted, open position and the closed position.

16. The crate of claim 15 wherein the braces are configured to pivot about axes perpendicular the front plane, wherein the front plane is perpendicular to the base, perpendicular to the end walls, and parallel to the rear wall.

17. The crate of claim 16 wherein the braces are pivotable about lower ends thereof.

18. The crate of claim 17 wherein the braces are pivotable and slidable about the lower ends thereof.

19. The crate of claim 17 wherein the braces are pivotably connected to one another between the upper ends thereof and lower ends thereof.

20. The crate of claim 15 wherein the braces are pivotably connected to one another between the upper ends thereof and lower ends thereof.

21. The crate of claim 15 wherein the braces are pivotably and slidably connected at the upper ends of the braces to the upper rail.

* * * * *